US007891651B2

(12) United States Patent
Wakabayashi et al.

(10) Patent No.: US 7,891,651 B2
(45) Date of Patent: Feb. 22, 2011

(54) POST-PROCESSING APPARATUS AND IMAGE FORMING SYSTEM

(75) Inventors: Hiroyuki Wakabayashi, Hachioji (JP); Toshio Shida, Higashiyamato (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 441 days.

(21) Appl. No.: 11/986,106

(22) Filed: Nov. 20, 2007

(65) Prior Publication Data

US 2008/0258373 A1 Oct. 23, 2008

(30) Foreign Application Priority Data

Apr. 17, 2007 (JP) ..... 2007-107979
Jul. 18, 2007 (JP) ..... 2007-186759

(51) Int. Cl.
*B65H 37/00* (2006.01)

(52) U.S. Cl. ..... 270/58.17; 270/58.07; 270/58.11; 270/58.12; 270/58.27

(58) Field of Classification Search ..... 270/58.07, 270/58.08, 58.09, 58.11, 58.12, 58.17, 58.27
See application file for complete search history.

(56) References Cited

U.S. PATENT DOCUMENTS 5,639,077 A * 6/1997 Hirano et al. ..... 270/58.12
6,120,015 A * 9/2000 Albright et al. ..... 270/58.07
6,361,036 B1 * 3/2002 Nakazawa ..... 270/58.07
6,436,024 B1 * 8/2002 Kobayashi ..... 493/405
6,719,283 B2 * 4/2004 Tsuchiya et al. ..... 270/58.07
6,895,212 B2 * 5/2005 Yamakawa et al. ..... 399/407
7,207,557 B2 * 4/2007 Kaneko et al. ..... 270/58.08
2004/0247356 A1 * 12/2004 Kaneko et al. ..... 399/407
2008/0106032 A1 * 5/2008 Kanda ..... 271/279

FOREIGN PATENT DOCUMENTS

JP 2000-318922 A 11/2000
JP 2000-355457 A 12/2000
JP 2005-15225 A 1/2005
JP 2007-1700 A 1/2007

OTHER PUBLICATIONS

Japanese Office Action dated Apr. 28, 2009 (3 pages), and English translation thereof (3 pages), issued in counterpart Japanese Application Serial No. 2007-186759.

* cited by examiner

*Primary Examiner*—Leslie A Nicholson, III
(74) *Attorney, Agent, or Firm*—Holtz, Holtz, Goodman & Chick, PC

(57) ABSTRACT

A post-processing apparatus including a conveyance unit containing a stacker for storing a plurality of sheets placed one on top of the other and a conveyance path having a curvature for ejecting a plurality of sheets placed one on top of the other in the stacker and a control section for controlling conveyance of sheets, wherein the control section controls aligning the plurality of sheets in the conveyance unit, feeding a plurality of sheets placed one on top of the other to a roller through the conveyance path having a curvature, driving the conveyance roller so as to feed the plurality of sheets, hitting the sheet ends against a stopper so as to align the sheet ends, further conveying the sheets with the ends aligned until a loop is formed on sheets, and punching the sheets using by a punching section subsequent to formation of the loop.

13 Claims, 22 Drawing Sheets

POST-PROCESSING APPARATUS AND IMAGE FORMING SYSTEM

This application is based on Japanese Patent Application Nos. 2007-107979 filed on Apr. 17, 2007 and 2007-186759 filed on Jul. 18, 2007 in Japanese Patent Office, the entire content of which is hereby incorporated by reference.

BACKGROUND OF THE INVENTION

The present invention relates to a post-processing apparatus and image forming system wherein the process of punching is applied by a post-processing apparatus to the sheet on which an image is formed by the image forming apparatus.

The conventional art known so far includes an image forming system wherein a post-processing apparatus having functions of punching, binding, folding and bookbinding the sheet having an image recorded thereon can be mounted on a photocopier as an image forming apparatus.

In the Patent Document 1, a punching unit is installed on the sheet conveyance path of a single sheet folding apparatus that allows various forms of folding to be performed. This punching unit punches each of the sheets one by one introduced from the image forming apparatus.

The Patent Document 2 shows a sheet conveyance apparatus characterized by avoiding misalignment of the front ends of the sheets fed in an overlapped state. To put it more specifically, a plurality of sheets stored in a gathering machine are conveyed by the rotation of a conveyance belt and the front ends of the sheets are brought in contact with a stopper so as to align the sheets. Then a stitching machine is used to perform saddle stitching.

In the image forming system equipped with a post-processing apparatus shown in the Patent Document 1, however, each sheet is punched by a punching apparatus one by one. During the process of punching, the succeeding sheet cannot be fed to the punching apparatus, and sheet ejection in the image forming apparatus must be held at a standby status. This reduces the productivity of the image forming apparatus. In such a system, punching at an accurate position of a plurality of sheets placed one on top of the other is not a major concern.

The system disclosed in the Patent Document 2 has no punching apparatus. During the post-processing operations such as saddle stitching and center folding, the succeeding sheet cannot be fed to the post-processing apparatus. Sheet ejection in the image forming apparatus must be held at a standby status. This reduces the productivity of the image forming apparatus. In this system, punching at an accurate position is not a major concern, although the ends of a plurality of sheets placed one on top of the other can be aligned.

[Patent Document 1] Japanese Unexamined Patent Application Publication No. 2005-15225

[Patent Document 2] Japanese Unexamined Patent Application Publication No. 2000-318922

SUMMARY

An object of the present invention is to solve the aforementioned problems and to ensure that the ends of a plurality of sheets placed one on top of the other are accurately aligned, post-processing operations such as punching can be applied to the accurate position of sheets, and post-processing operations can be performed sufficiently by the processing performances of an image forming apparatus, with the result that the productivity of the image forming apparatus is enhanced.

An object of the present invention can be achieved by the following post-processing apparatus and image forming system:

1. A post-processing apparatus including:

a conveyance unit containing a stacker for storing a plurality of sheets placed one on top of the other; and a conveyance path having a curvature for ejecting a plurality of sheets placed one on top of the other with the aforementioned stacker;

a stopper for aligning the edges of a plurality of sheets placed one on top of the other by hitting the edges;

a conveyance roller provided downstream of the aforementioned stopper in the direction of feeding the sheet;

a guide plate having a space section and forming a loop between the aforementioned stopper and conveyance roller;

a punching section for punching a plurality of sheets, placed between the aforementioned stopper and space section; and a control section for controlling conveyance of sheets;

wherein the aforementioned control section controls of steps of:

placing a plurality of sheets one on top of the other in the aforementioned conveyance unit;

feeding a plurality of sheets placed one on top of the other to the aforementioned conveyance roller through the aforementioned conveyance path having a curvature;

driving the aforementioned conveyance roller so as to feed a plurality of sheets for hitting the sheet edges against the aforementioned stopper so as to align the sheet edges;

further conveying the sheets with the edges aligned until a loop is formed on sheets; and punching the sheets by using the aforementioned punching section subsequent to formation of the loop.

2. An image forming system containing an image forming apparatus containing an image forming section for forming an image on a sheet, and a post-processing apparatus for punching the sheet, wherein the aforementioned post-processing apparatus includes:

a conveyance unit containing a stacker for storing a plurality of sheets placed one on top of the other; and a conveyance path having a curvature for ejecting a plurality of sheets placed one on top of the other with the aforementioned stacker;

a stopper for aligning the edges of a plurality of sheets placed one on top of the other by hitting the edges;

a conveyance roller provided downstream of the aforementioned stopper in the direction of feeding the sheet;

a guide plate having a space section and forming a loop between the aforementioned stopper and conveyance roller;

a punching section for punching a plurality of sheets, placed between the aforementioned stopper and space section; and a control section for controlling conveyance of sheets;

wherein the aforementioned control section controls of steps of:

placing a plurality of sheets one on top of the other in the aforementioned conveyance unit;

feeding a plurality of sheets placed one on top of the other to the aforementioned conveyance roller through the aforementioned conveyance path having a curvature;

driving the aforementioned conveyance roller so as to feed a plurality of sheets for hitting the sheet edges against the aforementioned stopper so as to align the sheet edges;

further conveying the sheets with the edges aligned until a loop is formed on sheets; and punching the sheets by using the aforementioned punching section subsequent to formation of the loop.

DETAILED DESCRIPTION OF THE PREFERRED EMBODIMENT

The following describes the present invention with reference to drawings, without being restricted to by the technological scope and meaning of the terminology in the description of the present invention.

Figure 1:
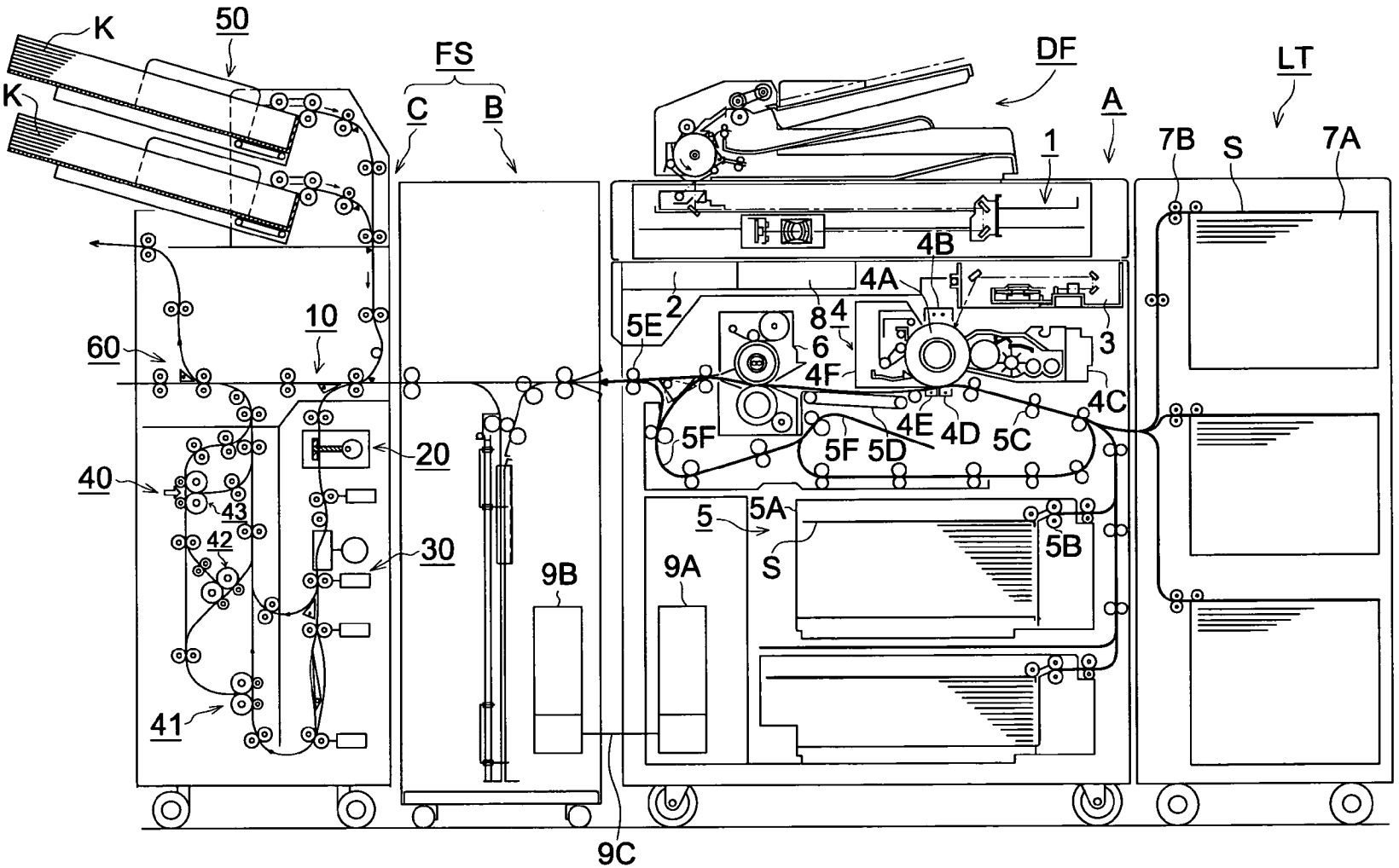
FIG. 1 is an overall schematic diagram representing an image forming system formed of an image forming apparatus, automatic document conveyance apparatus, large capacity sheet feeding apparatus, conveyance unit and a post-processing apparatus made up of post-processing section.

Referring to drawings, the following describes the image forming system of the present invention:

FIG. 1 is an overall schematic diagram representing an image forming system formed of an image forming apparatus A, automatic document conveyance apparatus DF, large capacity sheet feeding apparatus LT, conveyance unit B and post-processing apparatus FS made up of post-processing section C.

[Image Forming Apparatus]

The image forming apparatus A of FIG. 1 is provided with an image reading section 1, image processing section 2, image writing section 3, image forming section 4, sheet feed section 5 and fixing device 6.

The image forming section 4 includes a photoreceptor 4A, charging section 4B, development section 4C, transfer section 4D, separation section 4E and cleaning section 4F.

The sheet feed section 5 contains a sheet feed tray 5A, first sheet feed section 5B, the second sheet feed section 5C, intermediate conveyance section 5D, sheet ejection section 5E, and automatic duplex unit (ADU) 5F.

An operation display section 8 made up of an input section and display section is arranged on the upper front side of the image forming apparatus A. An automatic document conveyance apparatus DF is mounted on the upper portion of the image forming apparatus A. A conveyance unit B is arranged on the sheet ejection section 5E side on the left of the illustrated image forming apparatus A, and a post-processing section C is connected on the illustrated further left side. The conveyance unit B and post-processing section C constitutes a post-processing apparatus FS.

The image on one side or both sides of the document placed on the document table of the automatic document conveyance apparatus DF is read by the optical system of the image reading section 1. In the image processing section 2, the image data having been read is subjected to image processing such as analog processing, A/D conversion, shading correction and image compression, and is then fed to the image writing section 3.

In the image writing section 3, the laser beam of a semiconductor laser is applied to the photoreceptor 4A, and an electrostatic latent image is formed on the photoreceptor 4A. In the image forming section 4, such processing as charging, exposure, development, transfer, separation and cleaning is performed.

The image is transferred by the transfer section 4D onto the sheet S having been fed from the first sheet feed section 5B. The image is fixed onto the sheet S carrying the image by the fixing apparatus 6, and the sheet S is fed into the conveyance unit B from the sheet ejection section 5E. Alternatively, the image is again formed by the image forming section 4 on both sides of the sheet S having been fed to the automatic duplex unit 5F. After that, the sheet S is ejected by the sheet ejection section 5E, and is fed into the conveyance unit B.

The communications section of the control section 9A arranged inside the image forming apparatus A, and the communications section of the control section 9B mounted inside the conveyance unit B are connected by means of communications line 9C, and receives a input signal and control signal.

[Large Capacity Sheet Feeding Apparatus]

The large capacity sheet feeding apparatus LT includes a sheet loading section 7A, and a first sheet feed section 7B, and feeds sheets on a continuous basis so that the sheets are fed into the image forming apparatus A.

It is also possible to arrange such a configuration that the large capacity sheet feeding apparatus LT is connected to the conveyance unit B (to be described later), and a great number of sheets containing images formed thereon stored in the large capacity sheet feeding apparatus LT are directly fed to the conveyance unit B.

[Conveyance Unit]

Figure 2:
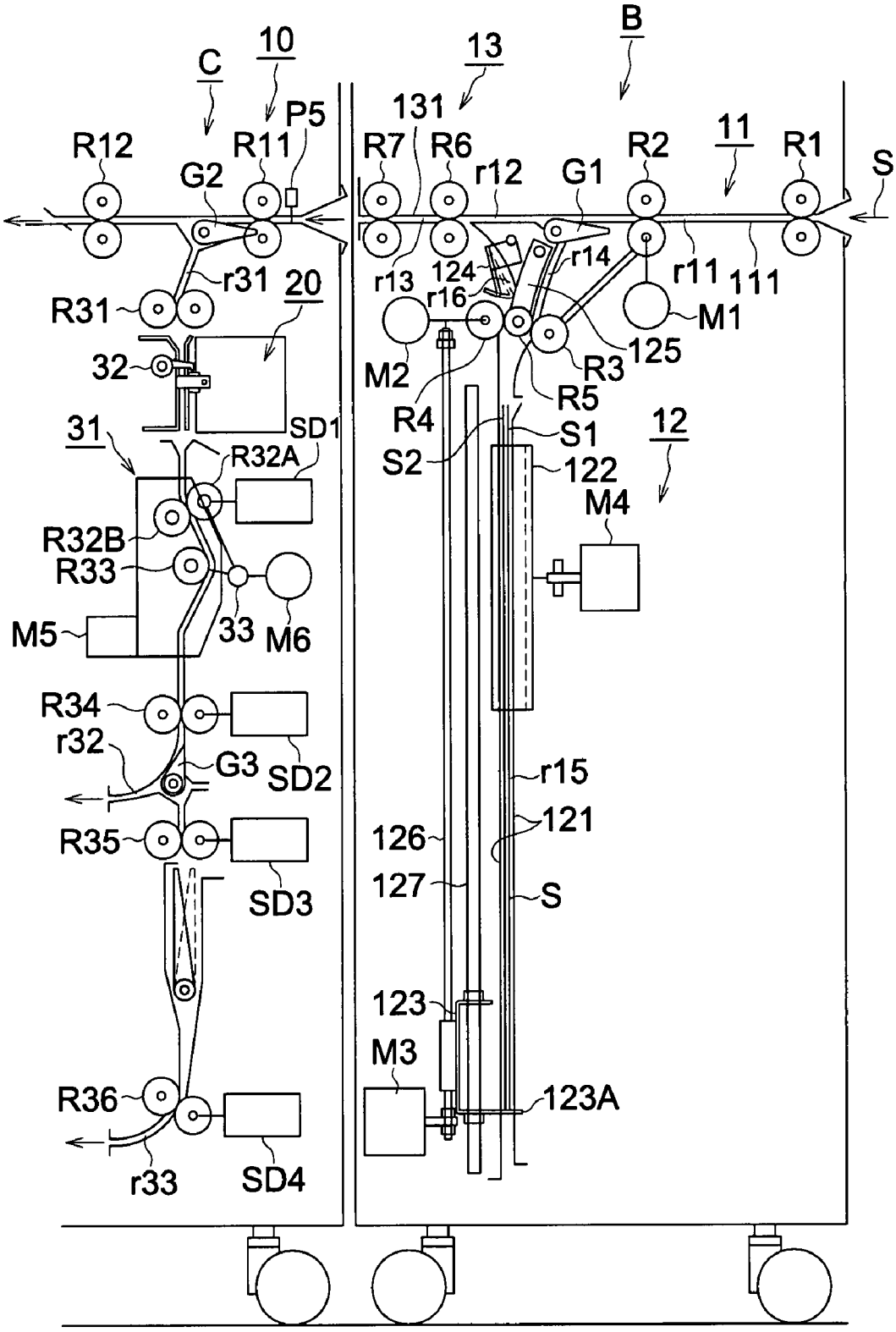
FIG. 2 is a front cross sectional view of a post-processing apparatus made up of a conveyance unit and a post-processing section.
Figure 3:
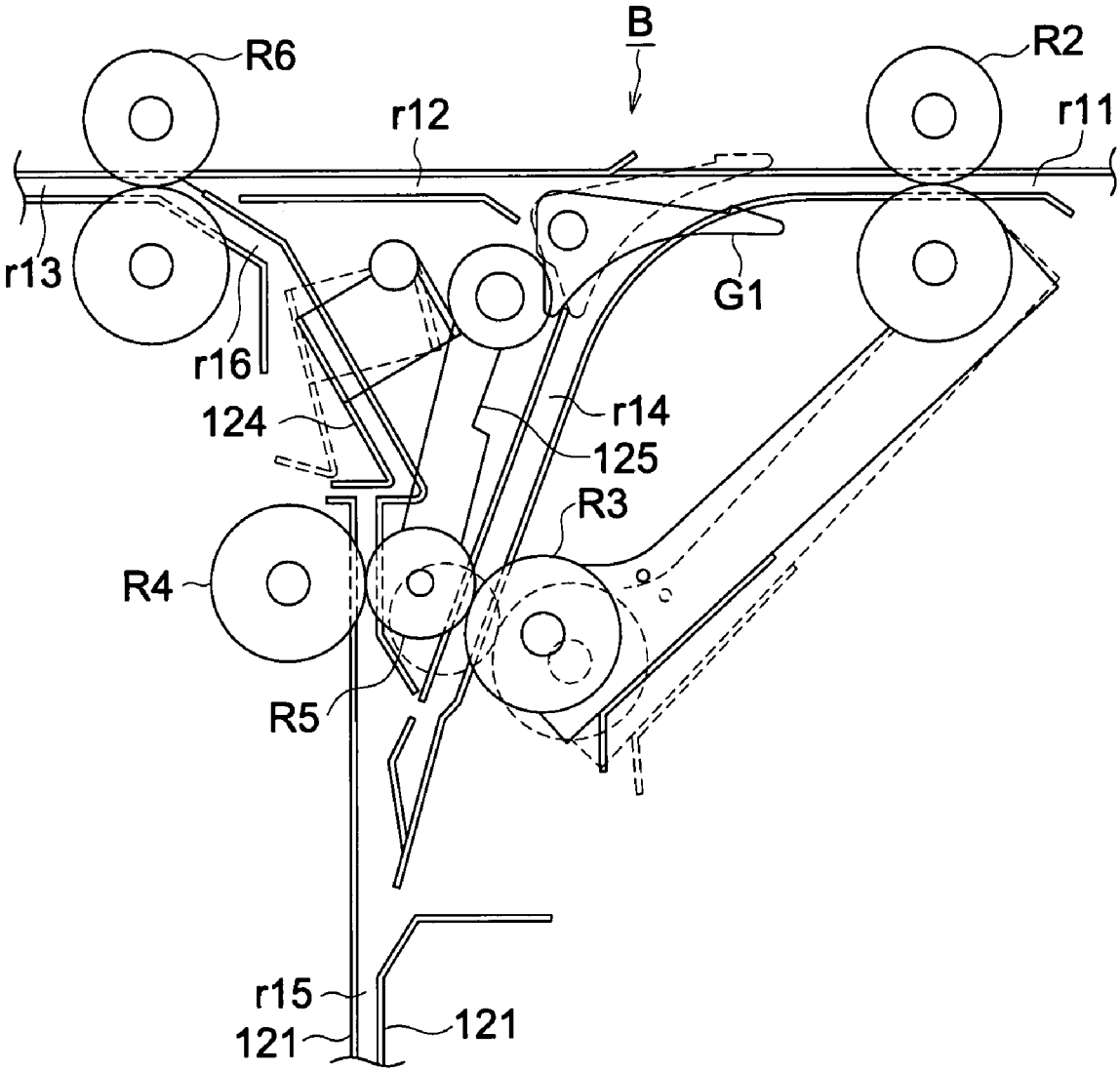
FIG. 3 is a partial cross sectional view representing the conveyance unit.

FIG. 2 is a front cross sectional view of a post-processing apparatus FS made up of a conveyance unit B and a post-processing section C. FIG. 3 is a partial cross sectional view representing the conveyance unit B.

The conveyance section of the conveyance unit B is provided with a loading section 11 for loading the sheet S, a stacker 12 for stacking the sheet S and an unloading section 13 for unloading the sheet S.

The loading section 11 has a sheet conveyance path r11 which includes conveyance rollers R1 and R2, and guide plate 111. In the loading section 11, the sheets S ejected from the sheet ejection section 5E of the image forming apparatus A are sequentially received and conveyed.

The stacker 12 includes a pair of guide plates 121 arranged in parallel, lateral alignment member 122, stopping member 123, stopper 124, loading drive roller R3, unloading drive roller R4, driven roller R5, sheet conveyance paths r14, r15 and r16.

The unloading section 13 is provided with a sheet conveyance path r13 containing a conveyance roller R6, sheet ejection roller R7 and guide plate 131.

The conveyance unit B is provided with a direct sheet ejection path and an overlapping conveyance path.

On the direct sheet ejection path, the sheets S received from the image forming apparatus A passes through the sheet conveyance path r11 of the loading section 11, then through the upper side of the first switching member G1 and the sheet conveyance path r12, further through the sheet conveyance path r13 of the unloading member 13 to be ejected, and are fed one by one into the post-processing section C.

In the overlapping conveyance path, the sheets S received from the image forming apparatus A are conveyed one by one through the sheet conveyance path r11 of the loading section 11, and then through the sheet conveyance path r14 on the lower side of the first switching member G1, and are fed into the stacker 12. They are sandwiched between the loading drive roller R3 and driven roller R5, and are stored into the sheet conveyance path r15 formed between two guide plates 121.

The succeeding sheets S are also conveyed through the sheet conveyance paths r11 and r14 and are stored in the sheet conveyance path r15 in an overlapped form.

The supporting plate 125 for supporting a driven roller R5 is driven and is rocked by a solenoid (not illustrated). The driven roller R5 comes in contact with either a loading drive roller R3 or unloading drive roller R4, and is driven and rotated.

The conveyance rollers R1 and R2, and loading drive roller R3 are driven and rotated by the motor M1, and is controlled to keep the same speed as the linear speed of ejecting the sheet S in the sheet ejection section 5E of the image forming apparatus A.

The motor M2 drives and rotates the unloading drive roller R4, conveyance roller R6, and sheet ejection roller R7 at one and the same linear speed.

The front end portion of the sheets S fed into the stacker 12 and stored in the sheet conveyance path r15 between the guide plates 121 are brought in contact with the stopping member 123 and are stopped.

The stopping member 123 is engaged with the belt 126 rotated by the motor M3 and is guided by a guide bar 127 to move in the vertical direction.

A pair of lateral alignment members 122 on the right and left sides are driven by the motor M4, and align the sheet S across the width.

The stopper 124 is driven and rocked by a solenoid (not illustrated) to open and close the sheet conveyance path r16.

FIGS. 4 through 9 are cross sectional views showing the operation of overlapping and conveying the sheets in the conveyance unit B.

Figure 4:
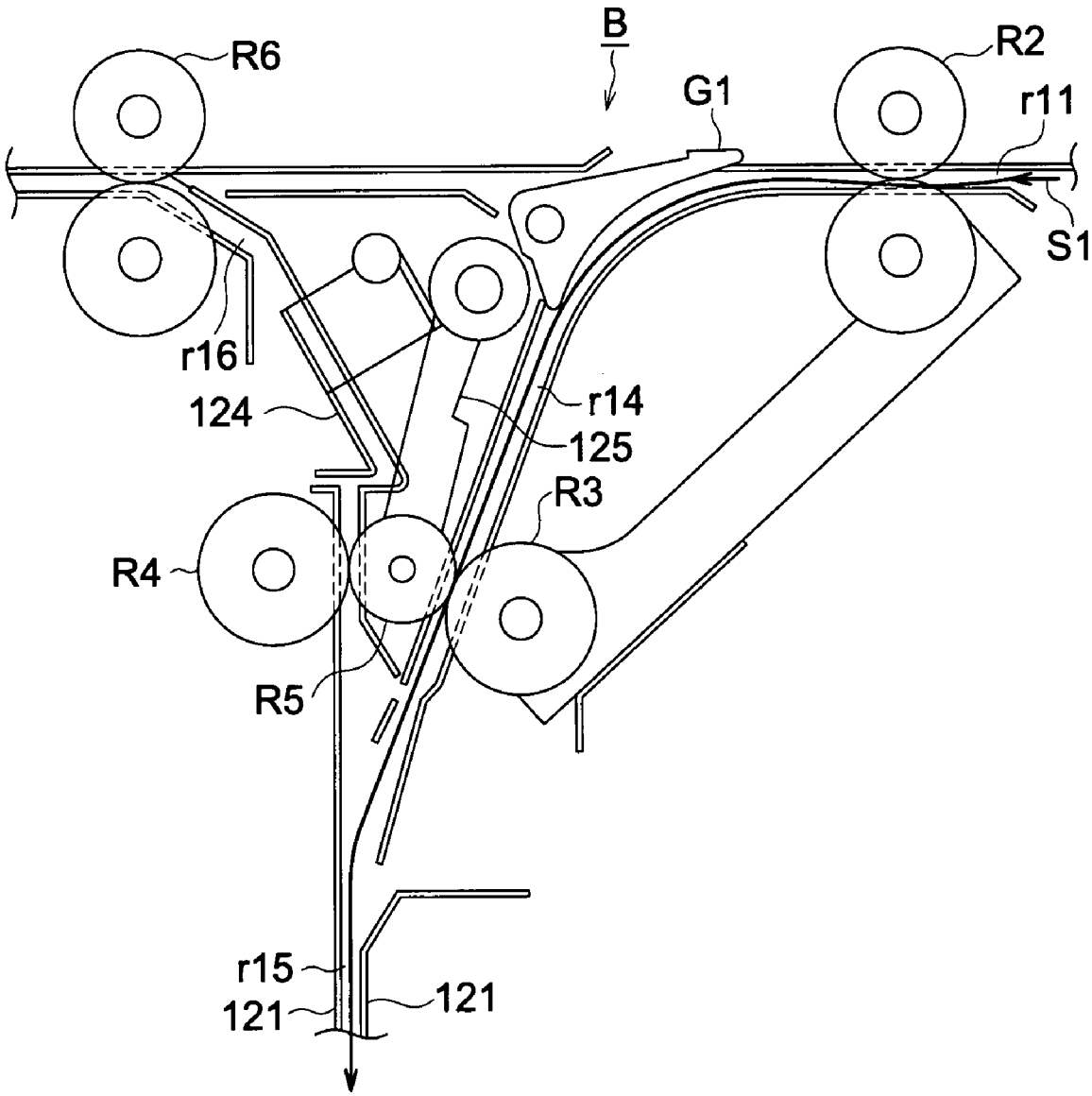
FIG. 4 is a cross sectional view representing the process of introducing a first sheet in the conveyance unit.

The following describes the process of conveying the sheet in the conveyance unit B:

(1) In FIG. 4, the driven roller R5 is driven and rotated by being pressed against the loading drive roller R3 which is driven and rotated. The first sheet S1 sandwiched between the conveyance rollers R1 and R2 is conveyed along the sheet conveyance paths r11 and r14, and is sandwiched between the loading drive roller R3 and driven roller R5 to be fed along the sheet conveyance path r15.

(2) The front end portion of the first sheet S1 fed to the sheet conveyance path r15 hits the stopping member 123 to stop (FIG. 2).

Figure 5:
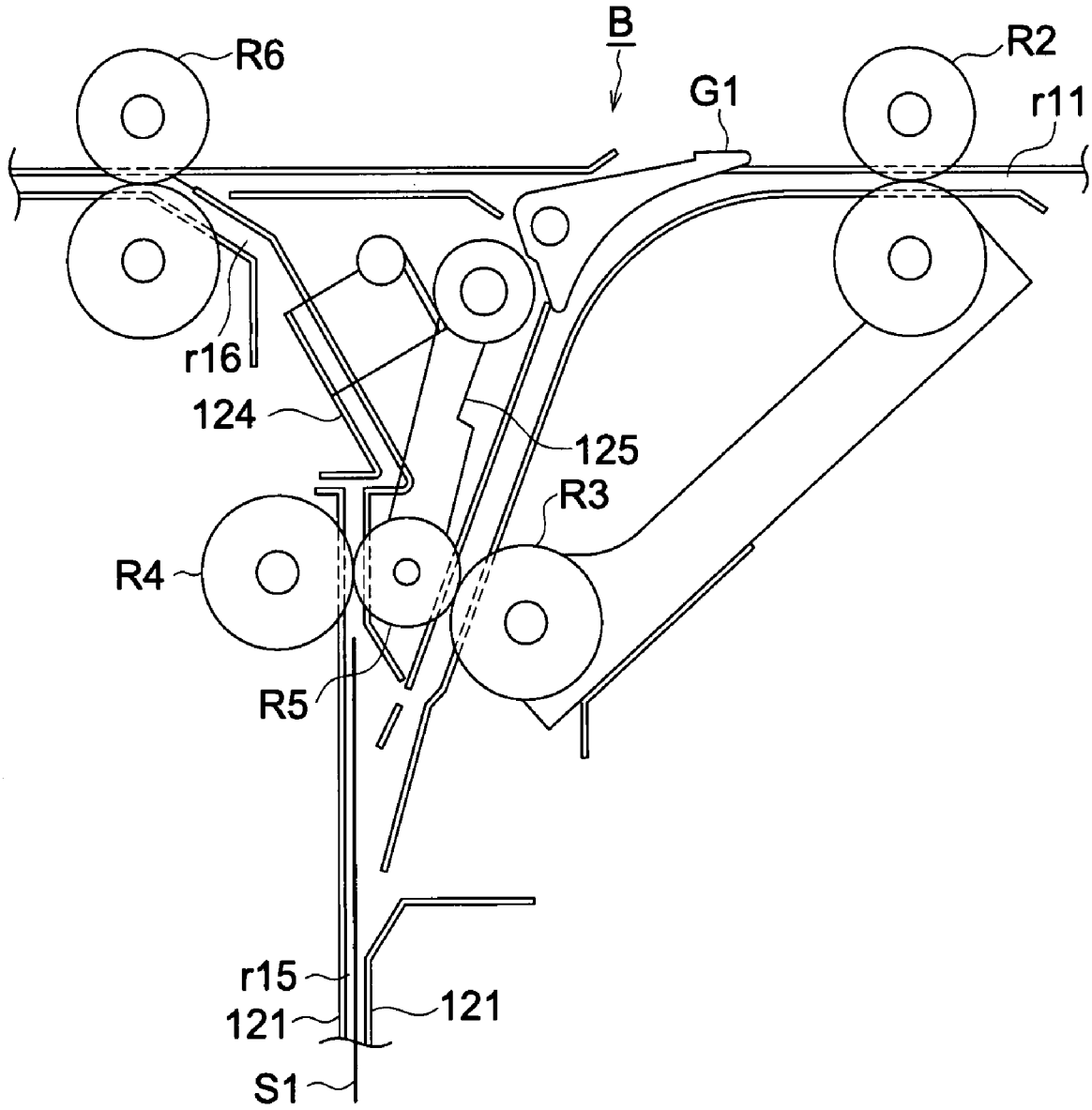
FIG. 5 is a cross sectional view representing how the first sheet is stored and stopped in the conveyance unit.

(3) In FIG. 5, the stopping member 123 is moved by the motor M3 to the first position raised by a predetermined distance from the initial position. It stops when the top end of the sheet S1 have reached the vicinity of the unloading drive roller R4.

Figure 6:
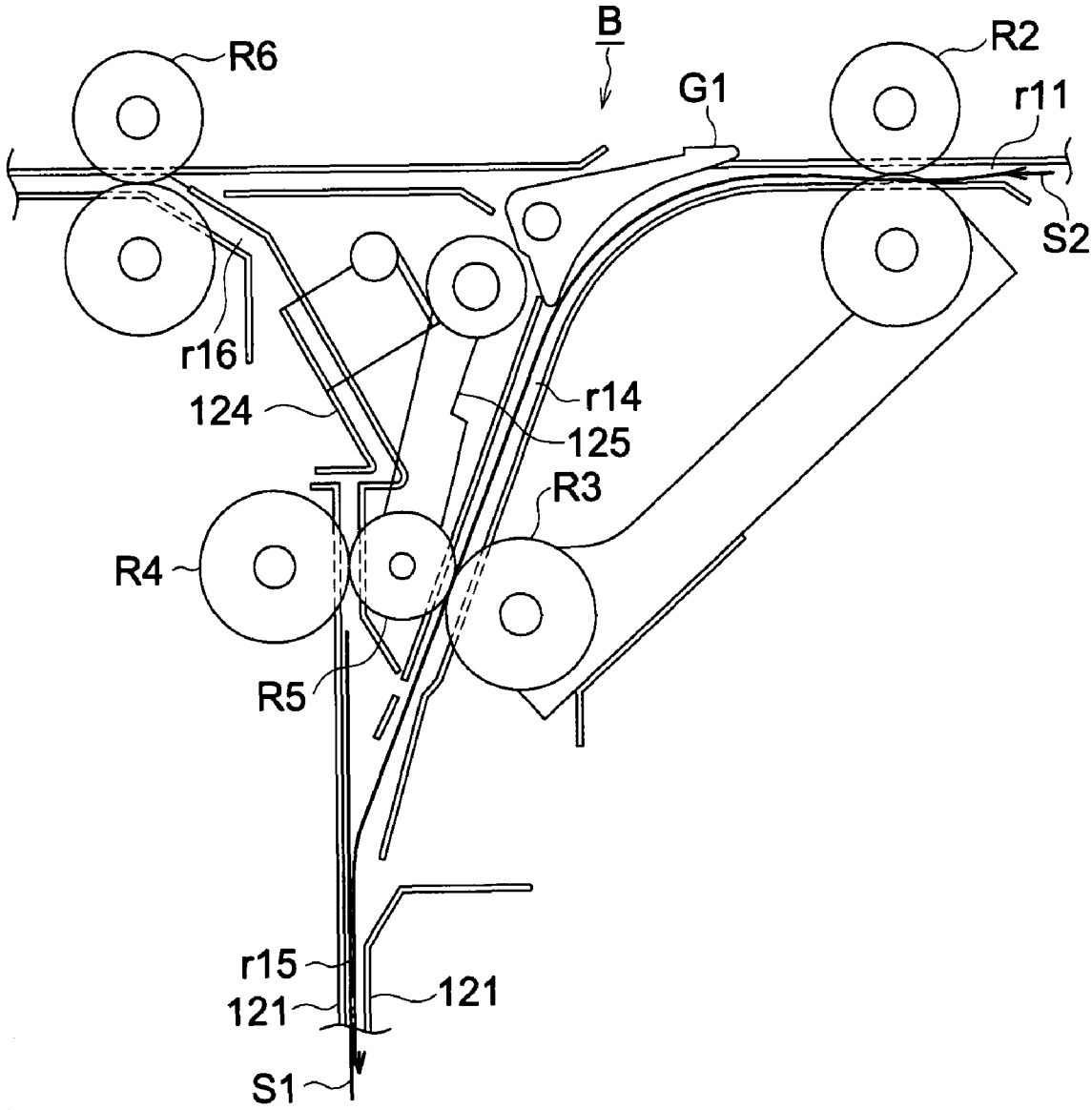
FIG. 6 is a cross sectional view representing the process of introducing a second sheet in the conveyance unit.

(4) In FIG. 6, the second sheet S2 sandwiched between the conveyance rollers R2 is fed along the sheet conveyance path r14. It is then sandwiched between the loading drive roller R3 and driven roller R5, and is conveyed along the sheet conveyance path r15 inside the guide plates 121.

Figure 7:
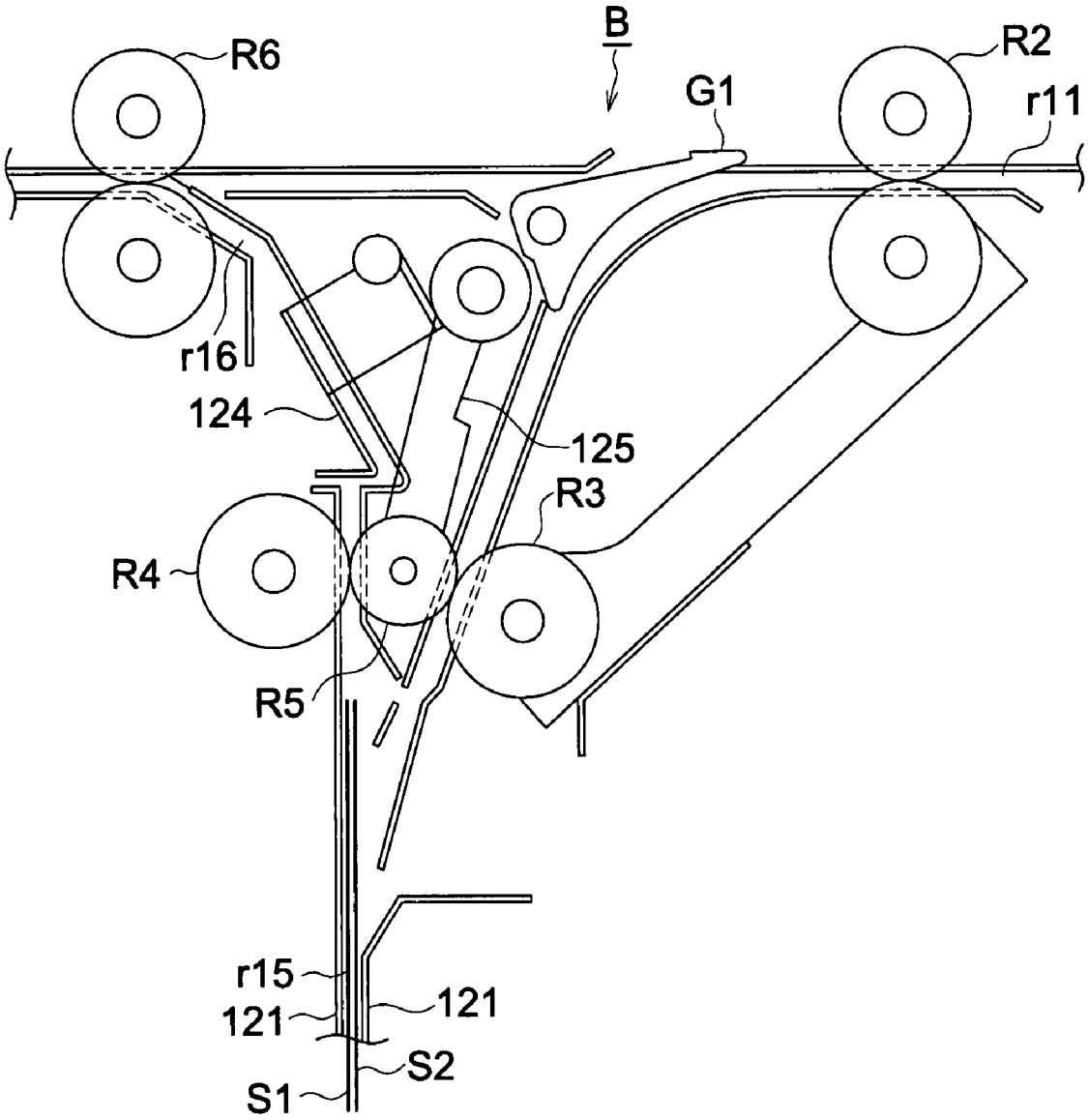
FIG. 7 is a cross sectional view representing how the second sheet is stored and stopped in the conveyance unit.

(5) In FIG. 7, the second sheet S2 is conveyed along the guide plates 121 of the sheet conveyance path r15 of the stacker 12, and the front end portion of the second sheet S2 hits the stopping surface 123A of the stopping member 123 of FIG. 2 so that the sheet stops traveling. In this case, the stopping member 123 is raised to the initial position from the first position. At this stop position, the second sheet S2 is placed one on top of the first sheet S1.

Figure 8:
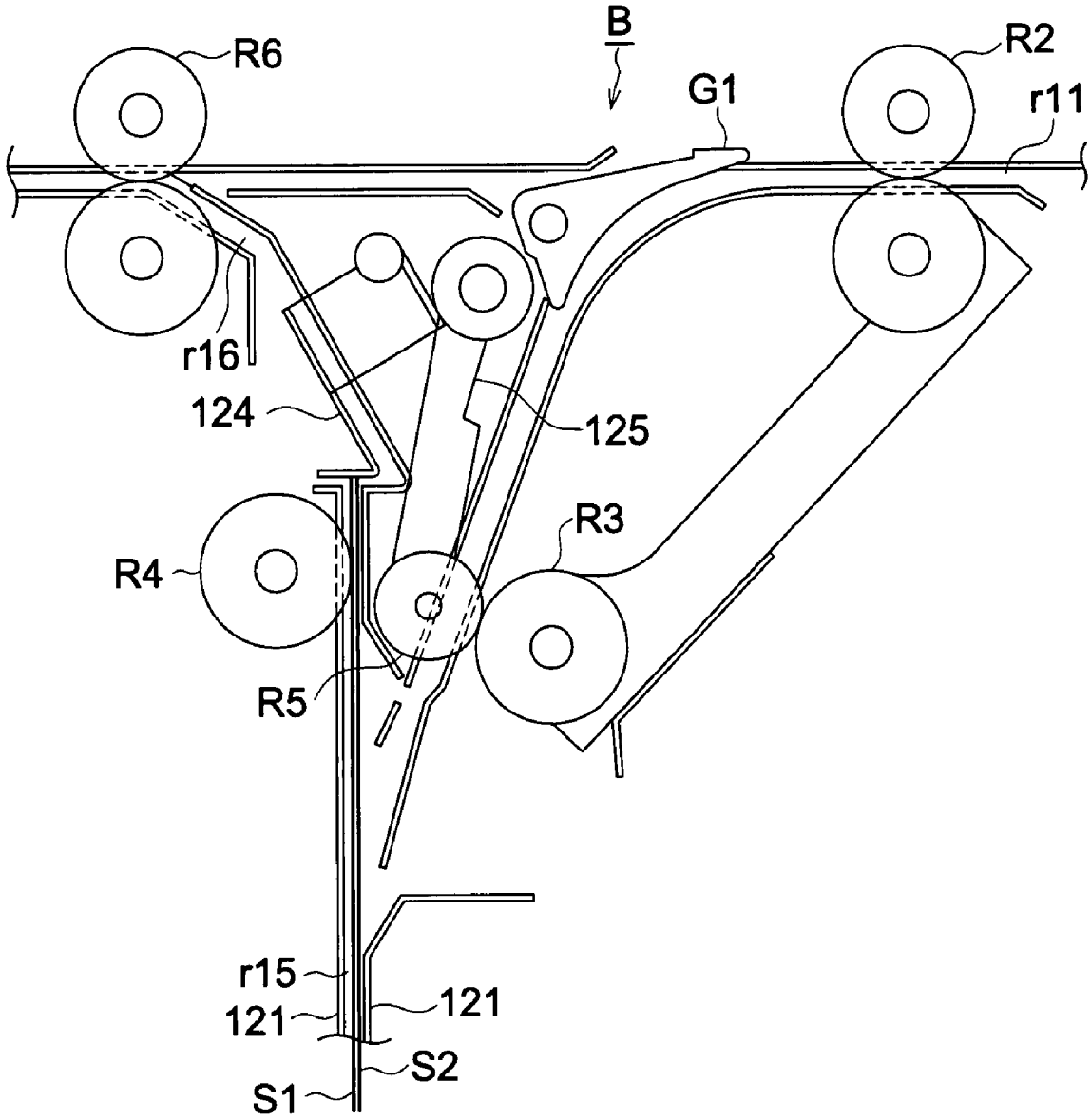
FIG. 8 is a cross sectional view representing how the ends of the sheets placed one on top of the other are aligned in the conveyance unit.

(6) In FIG. 8, the supporting plate 125 is rocked so that the driven roller R5 is separated from the unloading drive roller R4. After that, the stopping member 123 is moved by the motor M3 to the second position which is higher than the first position and is raised a predetermined distance from the initial position. The lower ends of the two sheets S1 and S2 placed one on top of the other is pushed upward by the stopping member 123. The upper ends of the two sheets S1 and S2 hit the stopper 124 to stop movement, so that sheets are aligned in the longitudinal direction. The stop position of the top ends of the two sheets S1 and S2 aligned in the vertical direction is located downward from the nip position of the unloading drive roller R4 in the traveling direction.

Simultaneously with longitudinal alignment or upon completion of longitudinal alignment, the lateral alignment member 122 is driven by the motor M4 to presses the edges of the sheets S1 and S2 across the width, whereby lateral alignment is performed (FIG. 2).

Figure 9:
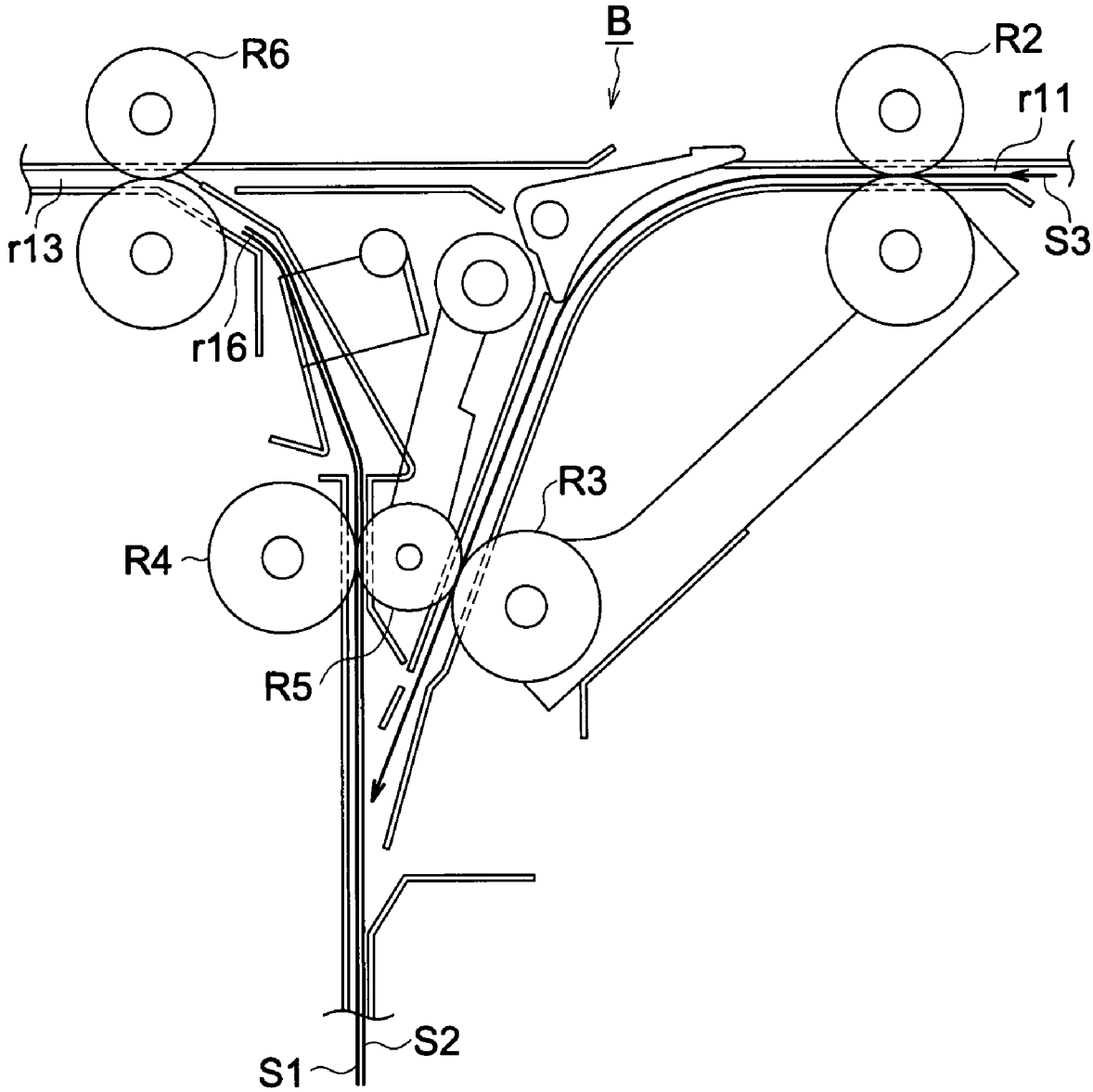
FIG. 9 is a cross sectional view representing how the sheets placed one on top of the other are ejected in the conveyance unit.

(7) In FIG. 9, the stopper 124 is driven by the solenoid (not illustrated) so that it is retracted from the sheet conveyance path r16 and the path becomes open. Through the drive and rotation of the unloading drive roller R4, two sheets S1 and S2 placed one on top of the other sandwiched between the unloading drive roller R4 and driven roller R5 are conveyed. They are further sandwiched between the conveyance roller R6 and sheet ejection roller R7 and are ejected. Almost simultaneously, a third sheet S3 conveyed by being sandwiched between the loading drive roller R3 and driven roller R5 is fed toward the interior of the guide plates 121 of the stacker 12.

When a punching section is mounted as a succeeding post-processing section C, the conveyance unit B places two or more sheets S on top of the other and conveys them to the succeeding post-processing section C, whereby two or more sheets S can be simultaneously punched.

Further, when a side stitching apparatus, saddle stitching apparatus, gluing and bookbinding apparatus or large-capacity sheet stacking apparatus is are mounted as the succeeding post-processing section C, the conveyance unit B places two or more sheets S on top of the other and conveys them to the succeeding post-processing section C to form a bundle of sheets, whereby quick post-processing operation can be performed.

[Post-Processing Section C]

Figure 10:
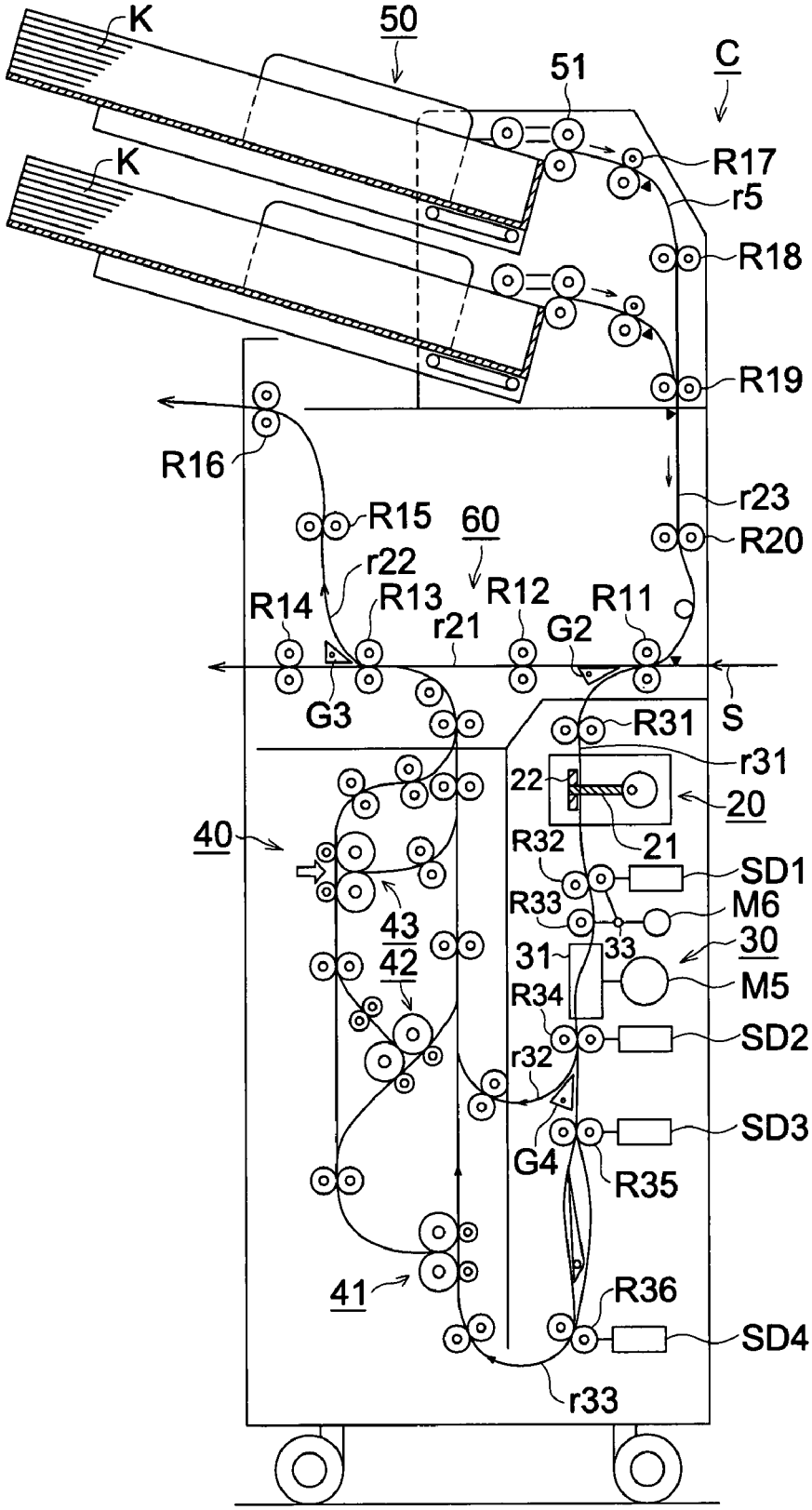
FIG. 10 is an overall schematic diagram representing a post-processing apparatus.

FIG. 10 is an overall schematic diagram representing an post-processing section C.

The post-processing section C is made up of a loading section 10, punching section 20, conveyance section 30, folding section 40, and cover sheet feed section 50.

The punching section 20 applies a process of punching to the sheet S conveyed from the image forming apparatus A, or conveyance unit B or the cover sheet K conveyed from the cover sheet feed section 50.

The conveyance section 30 conveys, to the folding section 40 or ejection section, the sheet S conveyed from the image forming apparatus A or conveyance unit B or the cover sheet K conveyed from the cover sheet feed section 50.

The folding section 40 uses the first folding section 41, second folding section 42 and third folding section 43 to apply processes of various forms of folding such as outer center folding, inner center folding, folding in the shape of a letter Z, outer folding in three, inner folding in three, inner folding in four (also called the double-leafed folding), and double parallel folding.

The cover sheet feed section 50 feeds the cover sheet K or insert sheet to the conveyance section 30.

The sheet S having been fed to the inlet roller R11 of the loading section 10 is branched to either the unloading section 60 and punching section 20 by the second switching member G2 for switching the conveyance paths.

When the process of punching and folding is not set on the operation display section 8, the second switching member G2 cuts off the sheet conveyance path leading to the punching section 20, and opens the sheet conveyance path leading to the unloading section 60.

The sheet S having been passed through the sheet conveyance path r21 leading to the unloading section 60 is sandwiched between the conveyance rollers R12 and R13 and is fed straight onward, until it is ejected by the sheet ejection roller R14.

The sheet S having been branched by the third switching member G3 passes through the conveyance roller R15 of the sheet conveyance path r22, and is ejected by the sheet ejection roller R16.

The cover sheet K or the insert sheet stored in the cover sheet feed section 50 is separated and fed by the separation roller 51. Being sandwiched between the conveyance rollers R17, R18, R19 and R20 of the sheet conveyance path r23, the sheet is fed along the sheet conveyance path upstream of the inlet roller R11.

When the process of punching or folding has been set, the second switching member G2 is swung by the solenoid (not illustrated) so that the sheet conveyance path r31 is kept open. The sheet S having been led into the sheet conveyance path r31 is fed to the conveyance section 30 through the punching section 20.

In the following description, the sheet S, the cover sheet K and the insert sheet are collectively called the sheet S.

<Conveyance Section 30>

The sheet S having been branched by the second switching member G2 of the loading section 10 is sandwiched between conveyance rollers R31 located downstream of the second switching member G2, and is fed to the punching section 20 by the sheet conveyance path r31.

Having passed through the punching section 20, the sheet S is sandwiched between the conveyance rollers R32, R33, R34, R35 and R36 and is fed to the conveyance section 30.

<Punching Section 20>

The puncher of the punching section 20 is made up of a punch 21 driven by the motor M8 and a die 22 fitting with the blade of the punch 21. The sheet S having been punched is fed to the conveyance section 30 located below.

Figure 11:
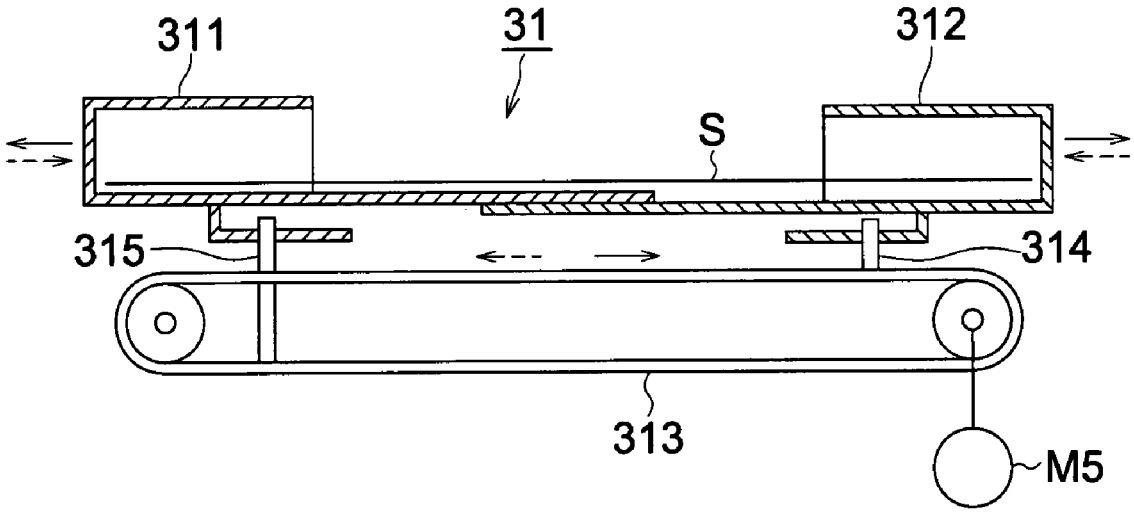
FIG. 11 is a cross sectional view representing the alignment section.

FIG. 11 is a cross sectional view representing the alignment section 31.

An alignment section 31 is arranged on the conveyance section 30 downstream of the punching section 20 to align the sheet S to be punched in the lateral direction.

A pair of alignment plates 311 and 312 on the right and left sides are respectively fixed onto the pins 314 and 315 which are secured on the endless belt 313 driven and rotated by the motor M5. The alignment plates 311 and 312 are moved through the pins 314 and 315 by the rotation of the belt 313, thereby applying a process of alignment across the width perpendicular to the direction of conveyance.

After that, as shown in FIG. 10, the motor M6 rotates the drive rollers such as the drive roller R32A, and conveyance rollers R33, R34, R35 and R36 through the drive shaft 33 in the forward and backward directions.

The conveyance rollers R32, R34, R35 and R36 are connected with the solenoids SD1, SD2, SD3 and SD4 as releasing members, and can come in contact with and get removed from the rollers facing each other.

The smaller sheets S having been punched but not to be folded pass along the sheet conveyance path r32 branched off by the fourth switching member G4, and are fed to the folding section 40. Independently of whether folding is required or not, the larger sheets S having been punched pass through the sheet conveyance path r33 located below the branching position of the fourth switching member G4 and are fed to the folding section 40.

The conveyance section 30 is provided with the fourth switching member G4, two smaller sheets S are stacked and fed, whereby simultaneous folding of two sheets (to be described later) can be performed. Needless to say, it is also possible to arrange such a configuration that the sheets pass freely through the fourth switching member G4, whereby each sheet S is folded.

Figure 12:
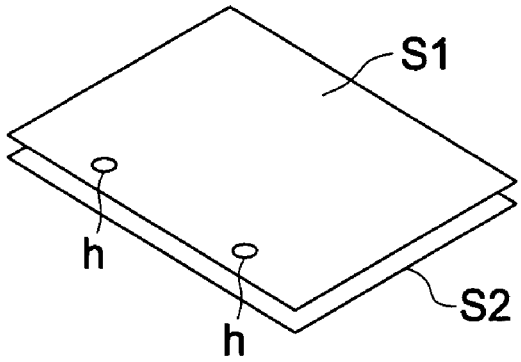
FIGS. 12(*a*) and 12(*b*) are perspective views representing the sheets punched and folded.
Figure 12:
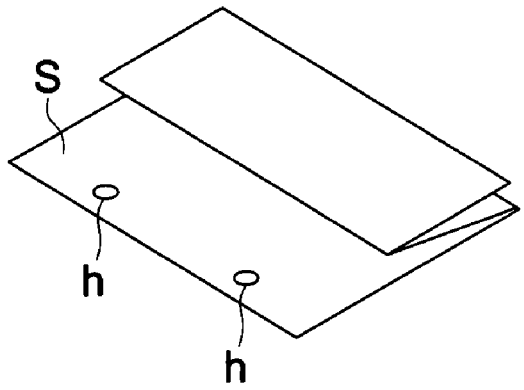

FIGS. 12(*a*) and 12(*b*) are perspective views representing the sheets S punched and folded;

The sheet S having a hole h by being punched by the punching member 20 is shown in the perspective view of FIG. 12 (*a*). The sheet S folded in the shape of a letter Z after having been punched by the punching member 20 is shown in the perspective view of FIG. 12 (*b*).

<Folding Section 40>

In FIG. 10, the sheets S fed from the conveyance section 30 to the folding section 40 are subjected to various forms of processing such as outer center folding, inner center folding, folding in the shape of a letter Z, outer folding in three, inner folding in three, inner folding in four, and double parallel folding in the first folding section 41, the second folding section 42 and the third folding section 43. Then these sheets S are ejected out of the system.

Figure 13:
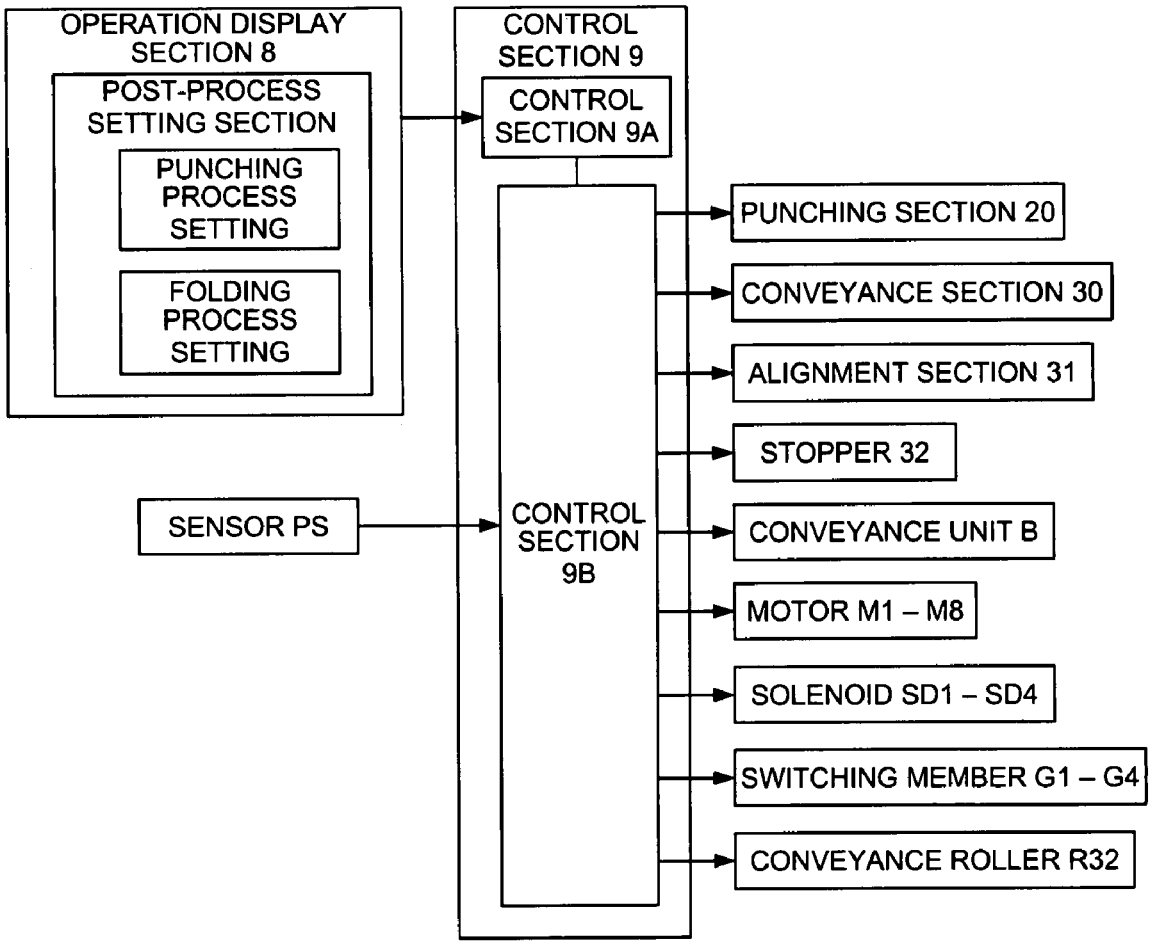
FIG. 13 is a block diagram showing the control in the present embodiment.

FIG. 13 is a block diagram showing the control in the present embodiment. The control section is made up of the control section 9A mounted on the image forming apparatus and the control section 9B arranged on the post-processing apparatus FS. The image forming system is controlled by collaboration between the control section 9A and control section 9B. The control section 9A and control section 9B include a CPU, ROM and RAM. The control section 9A controls each component of the image forming apparatus and sends the control information to the control section 9B of the post-processing apparatus FS to apply various forms of processing. The operation display section 8 has a post-processing setting section for setting the type of post-processing, and punching, folding and other processing are set on this section. Post-processing information set on the post-processing setting section is fed to the control section 9B through the control section 9A. The control section 9B controls the conveyance unit B, post-processing section C and others. To put it more specifically, the control section B controls the drive of the motors M1 through M4 of the conveyance unit B, each conveyance roller, lateral alignment member 122 and switching member G1, and feeds the sheets according to predetermined timing. Further, the control section B controls the drive of the punching section 20 of the post-processing section C, conveyance section 30, alignment section 31, stopper 32, motors M5 through M8, solenoids SD1 through SD4, and switching members G2, G3 and G4, whereby sheets are fed according to predetermined timing.

Embodiment 1

Figure 14:
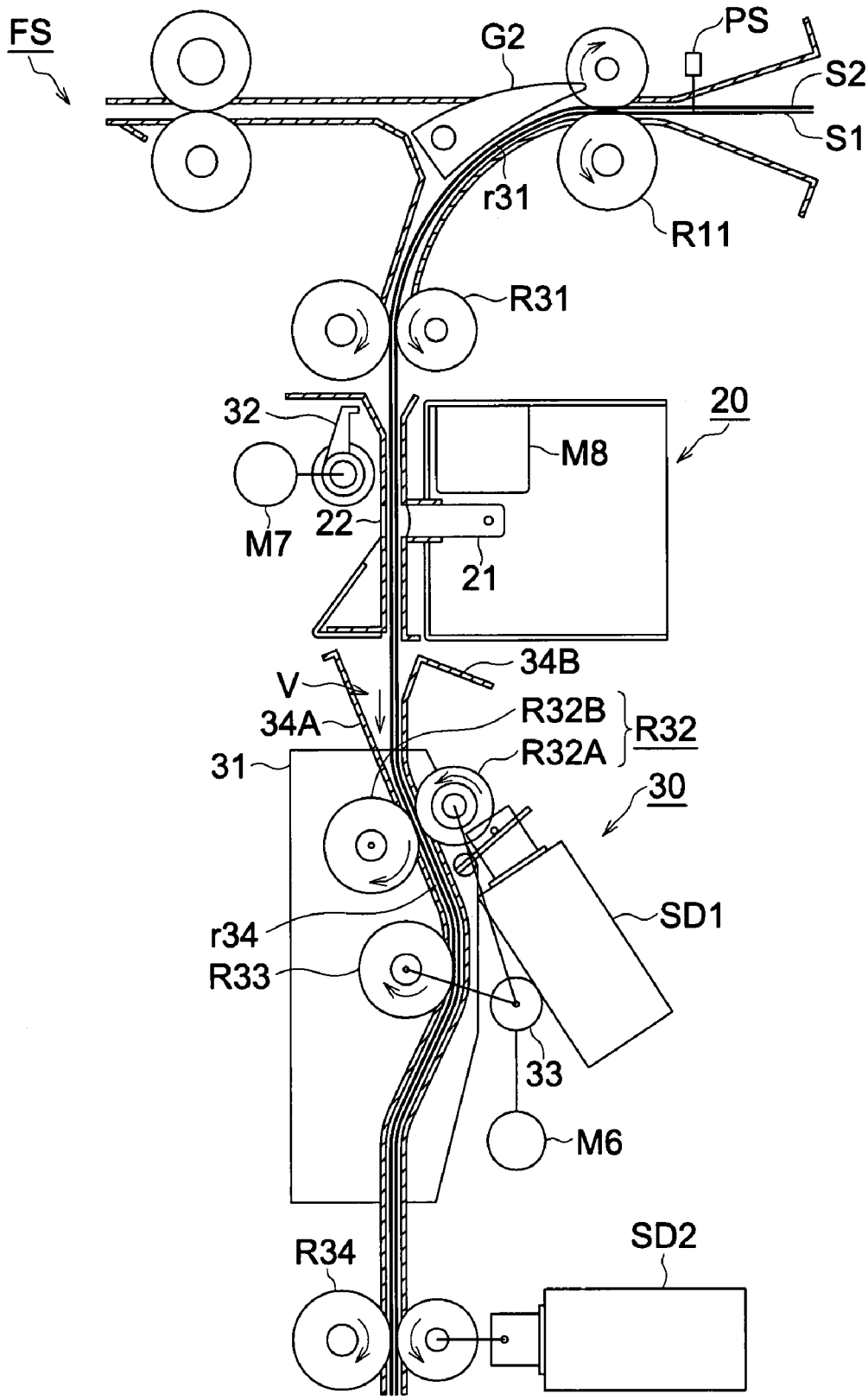
FIG. 14 is a cross sectional view representing a punching section and conveyance section in the present embodiment 1.

FIG. 14 is a cross sectional view representing a punching section 20 and conveyance section 30 in the present embodiment 1.

Two sheets S1 and S2 placed one on top of the other in the conveyance unit B are sandwiched between conveyance rollers R11 and R31, and are stored in the conveyance path formed by a pair of illustrated guide plates 34A and 34B on the right and left sides. The guide plates 34A and 34B form a conveyance path having a curvature and hold the sheets S1 and S2 in a curved form.

Below the conveyance roller R31 for sandwiching and conveying the sheets S1 and S2 placed one on top of the other, a guide plate 34A is arranged on one side of the sheet conveyance path located intermediate between the punching position of the punching section 20 and the conveyance roller R32. This guide plate 34A has an inclined surface widely opening toward the top, and includes a V-shaped space section V formed between this guide plate 34A and sheet conveyance path r34.

Referring to the cross sectional views of FIGS. 14 through 18, the following describes the process of punching to a plurality of sheets S ejected from the conveyance unit B (FIG. 2) by the post-processing section C:

(1) In FIG. 14, the sheets S1 and S2 placed one on top of the other having been ejected from the conveyance unit B and led into the inlet roller R11 at the time of punching are led to the sheet conveyance path r31 below the second switching member G2, and are sandwiched and conveyed by the conveyance roller R31. The sheets S1 and S2 conveyed downward pass through the punching section 20 which is not driven, and are sandwiched between the drive roller R32A rotated by the motor M6 of the drive source and the driven roller R32B. The sheets passes along the sheet conveyance path r34 formed in a form of curvature and the conveyance roller R33. Further, the sheets are conveyed by the conveyance roller R34.

Figure 15:
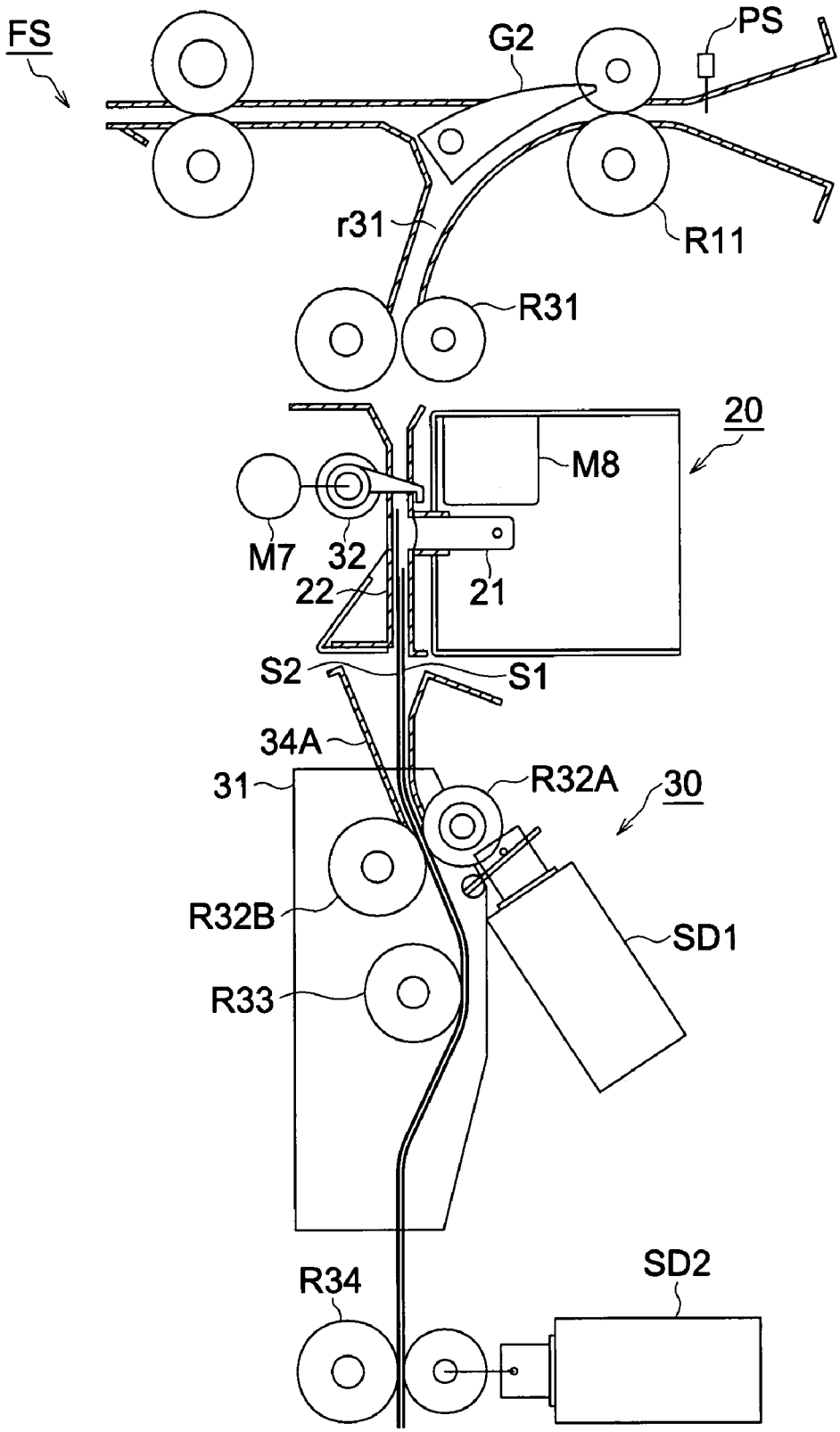
FIG. 15 is a cross sectional view showing how the sheet conveyance path is closed by the operation of the stopper in the post-processing section of the present embodiment 1.

(2) In FIG. 15, the sensor PS arranged upstream of the inlet roller R11 along the sheet conveyance path detects the passage of the rear end of the sheets S1 and S2 placed one on top of the other. Then after the lapse of a predetermined time, the drive of the motor M6 is suspended and the rotation of the drive roller R32A, driven roller R32B, conveyance roller R33 and conveyance roller R34 is suspended. Then the conveyance of the sheets S1 and S2 is suspended. In this suspended state, the rear end of the sheets S1 and S2 in the direction of conveyance stops below and in the vicinity of the stopper 32.

(3) When the sheets S1 and S2 are suspended, the solenoid SD1 as a releasing member operates to move the drive roller R32A away from the driven roller R32B. Simultaneously the solenoid SD2 operates so that the conveyance roller R34 is detached, and sandwiching of the sheets S1 and S2 is released.

Immediately when sandwiching of the sheets S1 and S2 has been released, the motor M5 of FIG. 11 starts operation so that the alignment section 31 is driven. Then the sheets S1 and S2 are aligned across the width. Upon completion of alignment, the operation of the solenoids SD1 and SD2 is suspended. Pressure contact is applied to the drive roller R32A and driven roller R32B, and to the conveyance roller R34.

At the time of alignment, sandwiching of the sheets S1 and S2 is temporarily released. The sheets S1 and S2 slide along the guide plate of the sheet conveyance path r34 formed in a curvature, and the lowering movement is suppressed by the frictional resistance, with the result that sheets are held in a suspended state.

(4) Upon completion of alignment, the stopper 32 is swung by the drive of the motor M7 and the sheet conveyance path is closed. Then the drive roller R32A is reversed by the drive of the motor M6 in the reverse direction, and the sheets S1 and S2 placed one on top of the other are fed upward in the reversed direction. The front end portion of the reversed sheets S1 and S2 in the traveling direction hits the stopper 32 and the sheets are aligned.

When sheets S1 and S2 placed one on top of the other are to be fed, the sheets S1 and S2 placed one on top of the other are fed along the conveyance path containing a curvature from the sheet conveyance path r16 of the conveyance unit B to the sheet conveyance path r31 of the post-processing section C, as shown in FIG. 2. The front end portion of the sheet S1 passing inside the conveyance path containing a curvature passes through the punching section 20 earlier than the front end portion of the sheet S2 passing outside the conveyance path. To be more specific, the length of the conveyance path of the sheet S1 located inside is shorter than that of the conveyance path located outside. Accordingly, the sheets stop at different positions wherein the end of the sheet S1 (the top end in the drawing) is lower than that of the sheet S2, as shown in FIG. 15.

Figure 16:
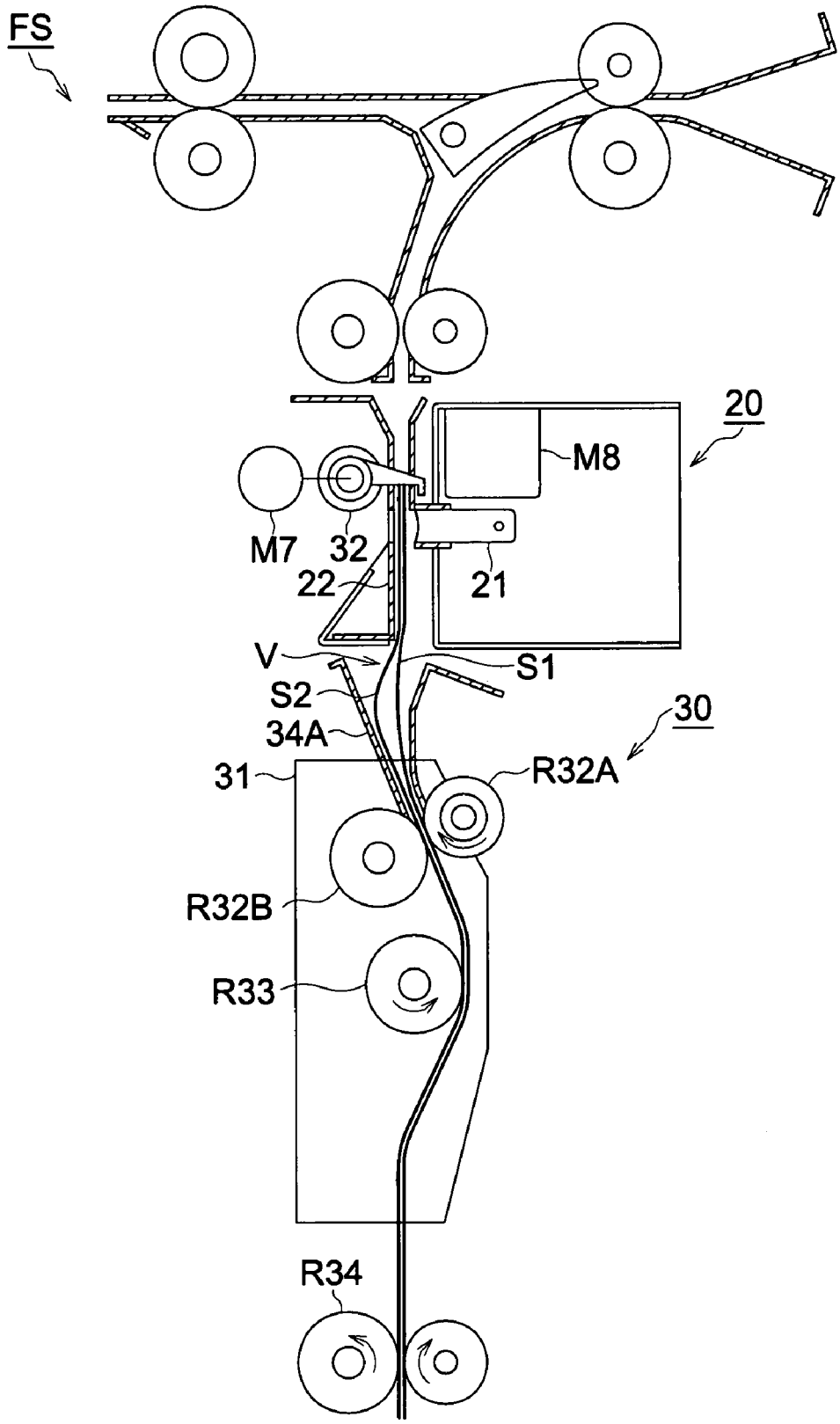
FIG. 16 is a cross sectional view showing how the ends of the sheets placed one on top of the other are aligned in the post-processing section of the present embodiment 1.

(5) in FIG. 16, when the motor M6 has been driven, the drive roller R32A starts reverse rotation. Sandwiched between this roller and the driven rollers R32B, the sheets S1 and S2 are reversely fed in the upward direction. The top ends of the sheets S1 and S2 reaches the position wherein they hit the stopper 32. The motor M6 continues drive for reverse feeding of sheets S1 and S2 placed one on top of the other. The ends of the sheets S1 and S2 are controlled and stopped by the stopper 32. The intermediate portion of the sheets S1 and S2 forms a loop in the space section V formed by the guide plate 34A and the sheets are stopped, whereby the ends of the sheets S1 and S2 are aligned. Then the drive of the motor M6 stops.

Figure 17:
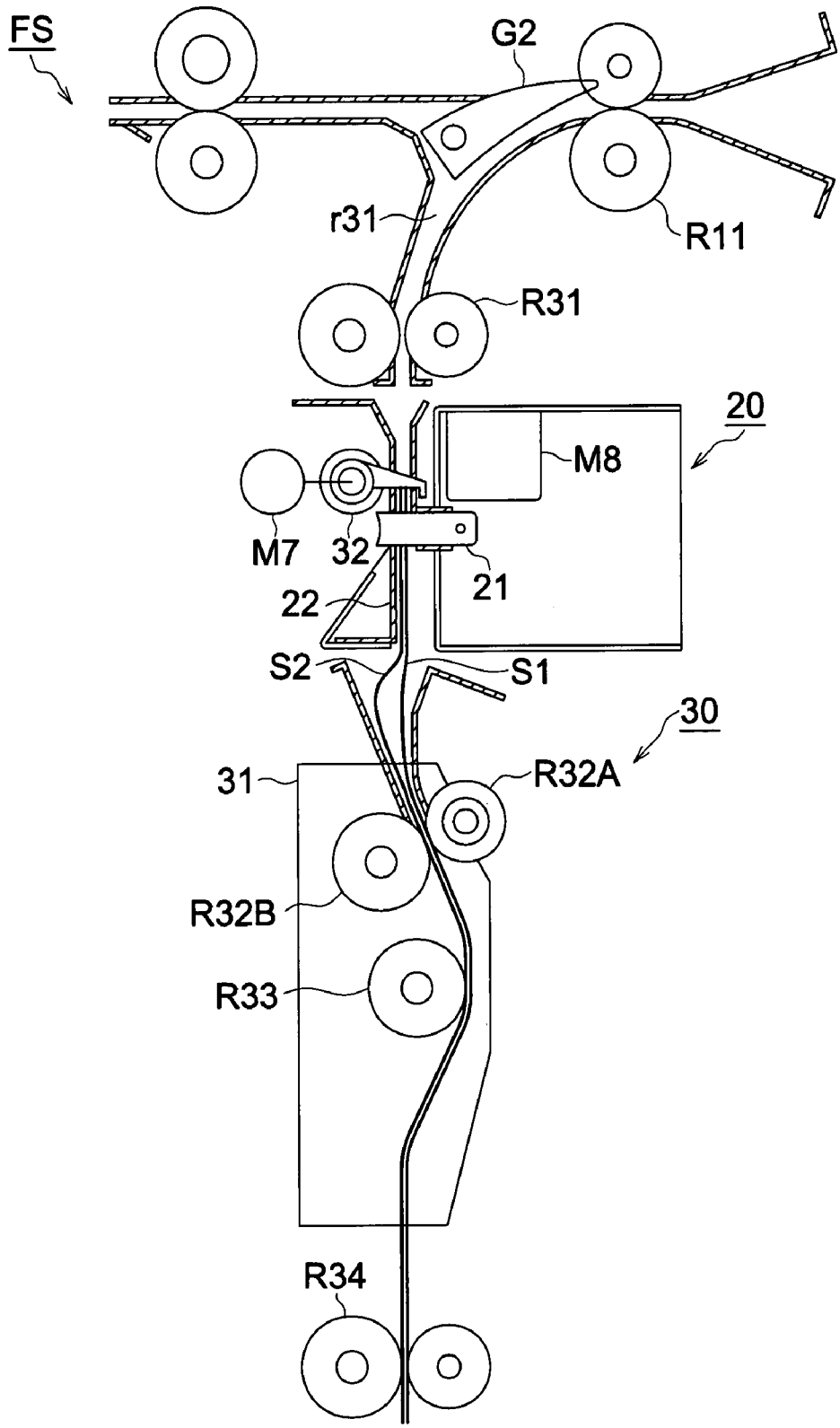
FIG. 17 is a cross sectional view showing how sheets placed one on top of the other are punched in the post-processing section of the present embodiment 1.

(6). In FIG. 17, when the ends of the sheets S1 and S2 are stopped by hitting the stopper 32, the plurality of sheets are punched simultaneously by the punching section 20.

Figure 18:
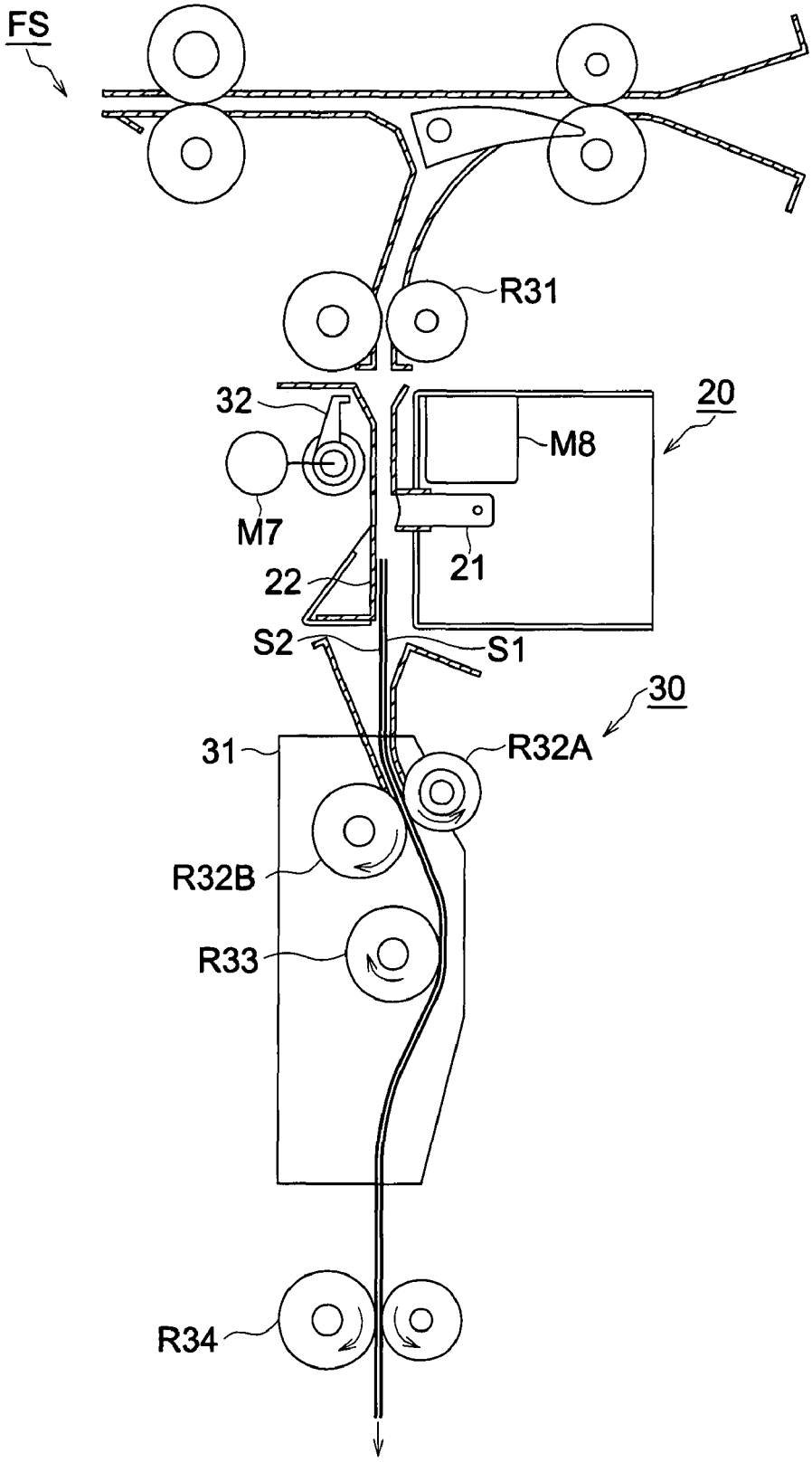
FIG. 18 is a cross sectional view showing how the sheets placed one on top of the other are ejected in the post-processing section of the present embodiment 1.

(7) In FIG. 18, after punching, pressure contact of the drive roller R32A, driven roller R32B and conveyance roller R34 is released so that sandwiching of the sheets S1 and S2 is released. After the loop of the sheets S1 and S2 has been removed, the sheets are again sandwiched. This arrangement ensures alignment of the front ends and rear ends of the sheets S1 and S2. This is followed by the step of swinging the stopper 32 by such a driving device as a solenoid so that the sheet conveyance path is opened. The sheets S1 and S2 sandwiched between the drive roller R32A rotated in the forward direction by the motor M6 and the driven roller R32B are sandwiched between the conveyance rollers R34 and are fed in the downstream direction.

In the post-processing apparatus FS described above, when sheets placed one on top of other are fed, a difference in the length of the conveyance path between the inside and outside is caused by the curvature of the sheet conveyance path. This will result in punching misalignment. When a plurality of sheets are pressed against the stopper to align the ends, the sheet S2 first hits the stopper and a loop is formed on the sheet S2 by further conveyance, whereby the misaligned sheet S1 is also conveyed to reach the stopper. Thus, the sheets S1 and S2 are aligned without the ends of the sheets being misaligned.

Embodiment 2

Figure 19:
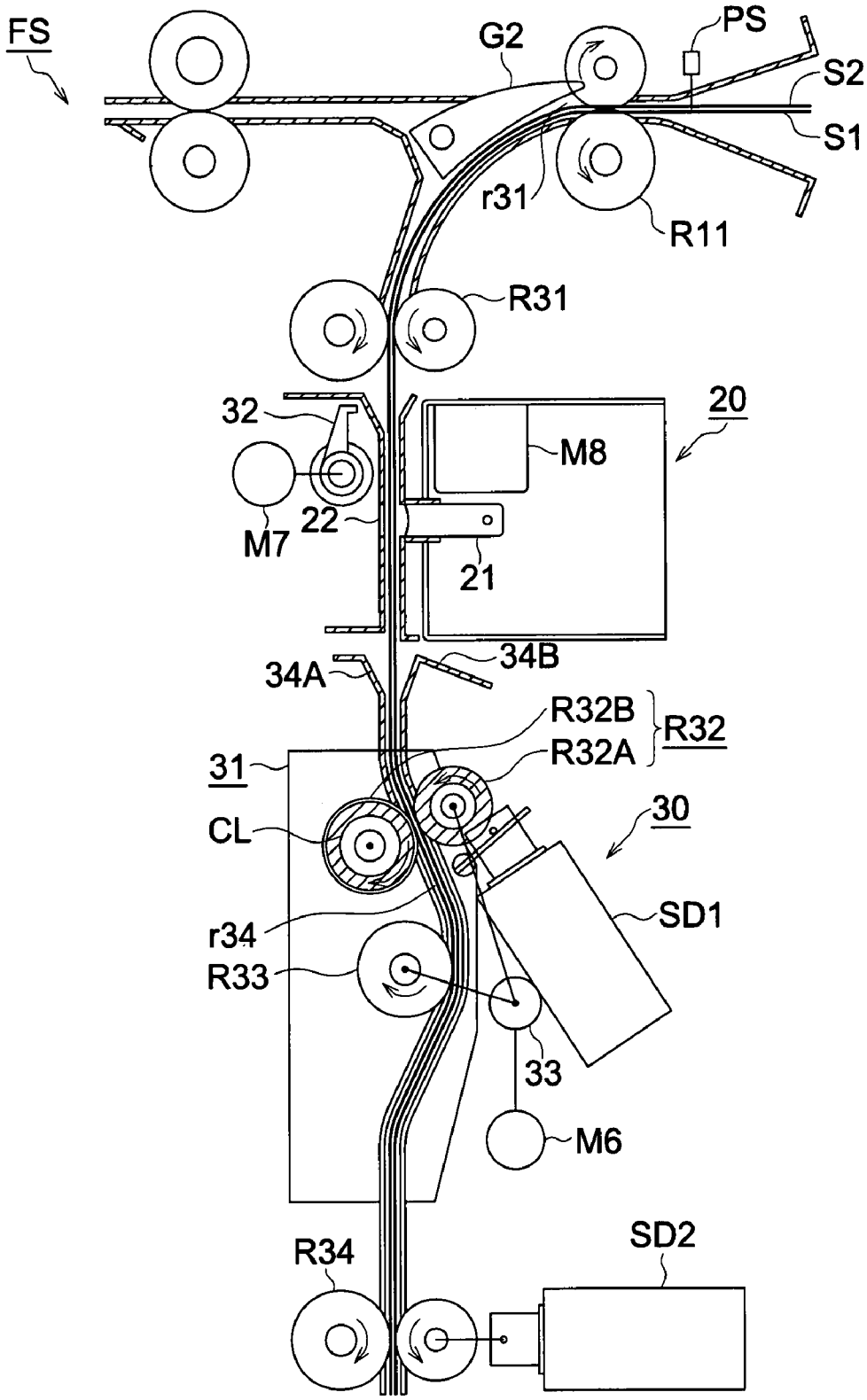
FIG. 19 is a cross sectional view showing the punching section 20 and conveyance section 30 of the present embodiment 2.

FIG. 19 is a cross sectional view showing the punching section 20 and conveyance section 30 of the embodiment 2.

In the conveyance unit B, the sheets S1 and S2 placed one on top of the other are sandwiched between the conveyance rollers R11 and R31, and are put in the conveyance path made up of a pair of illustrated guide plates 34A and 34B on the right and left sides. The guide plates 34A and 34B form a conveyance path containing a curvature and hold the sheets S1 and S2 in a curved form.

The conveyance roller R32 includes the driven roller R32B incorporating the one-way clutch CL and a drive roller R32A that is connected to the motor M6 to rotate in the forward and reverse directions and supported detachably from the driven roller R32B.

The control section (control section B) provides control so as to rotate the drive roller R32A in the forward direction when the sheets S1 and S2 are introduced. When the sheets S1 and S2 are to hit the stopper 32, the drive roller R32A is driven in the reverse direction.

When the sheets S1 and S2 are introduced into the conveyance section 30, the driven roller R32B is pressed against the drive roller R32A and is driven and rotated. When the sheets are hit against the stopper 32 to align the ends, that is, when the drive roller R32A drives in the reverse direction, rotation is prevented by a one-way clutch CL against the rotation of the drive roller R32A.

To increase the frictional force of the drive roller R32A with the sheet and to increase the conveyance force, this roller is coated with the elastic rubber member R32C. Also to increase frictional force of the peripheral surface of the driven roller R32B with the sheet and to hold the sheet, the rubber member R32D is coated.

Referring to the cross sectional views of FIG. 19 through FIG. 23, the following describes the process wherein a plurality of sheets S ejected from the conveyance unit B (FIG. 2) is punched by the post-processing section C:

(1) In FIG. 19, at the time of punching, the sheets S1 and S2 placed one on top of the other ejected from the conveyance unit B and introduced into the inlet roller R11 is led to the sheet conveyance path r31 located below the second switching member G2. Being sandwiched between the conveyance rollers R31, the sheets are conveyed. The sheets S1 and S2 conveyed downward pass through the punching section 20 which is not driven. Sandwiched between the drive roller R32A rotated by the motor M6 of a drive source and the driven roller R32B, the sheets pass through the sheet conveyance path r34 formed in a curved shape and conveyance roller R33, and are further conveyed by the conveyance roller R34.

Figure 20:
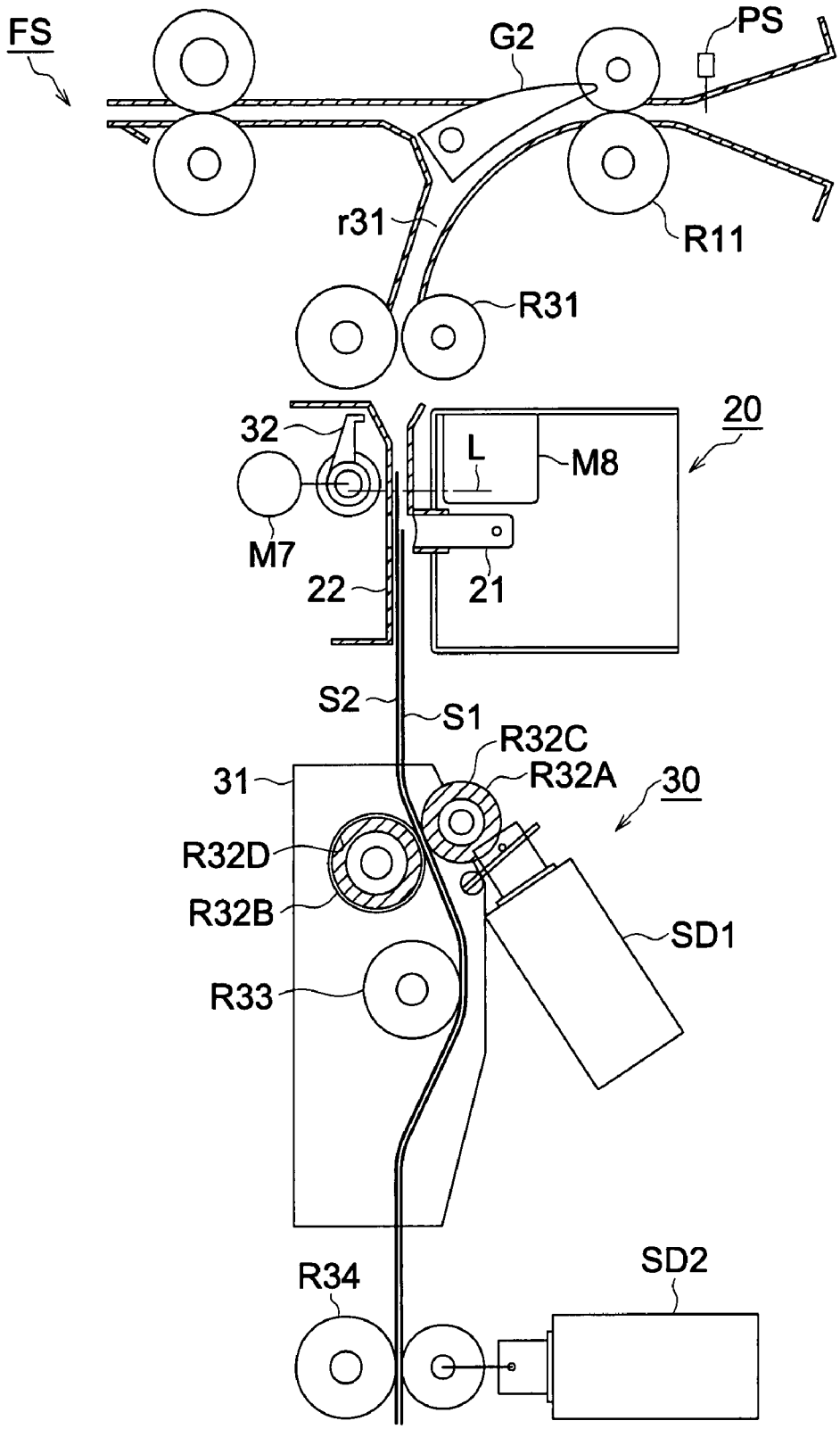
FIG. 20 is a cross sectional view showing the status immediately before the sheet conveyance path is closed by the operation of the stopper in the post-processing section of the present embodiment 2.
Figure 21:
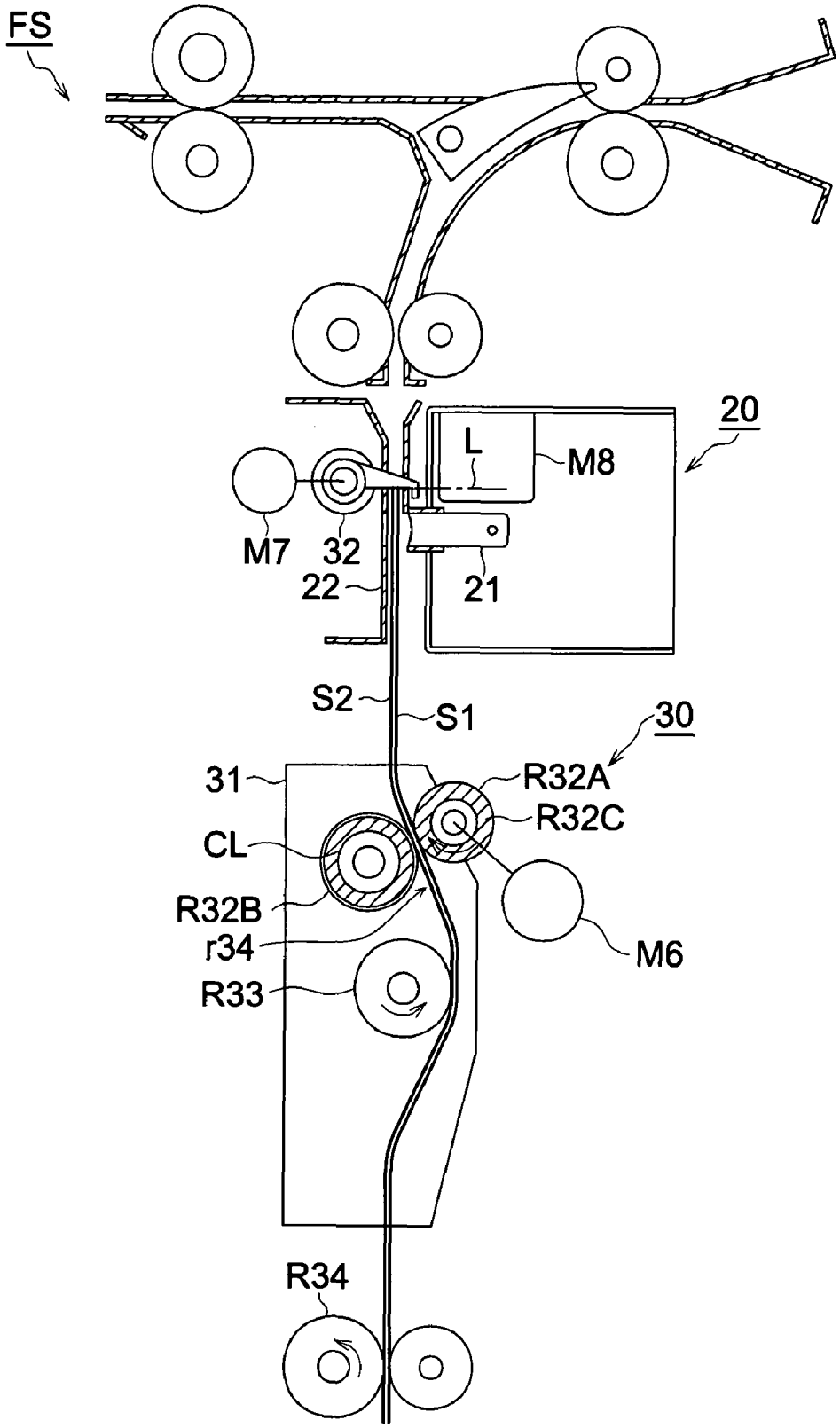
FIG. 21 is a cross sectional view showing that the ends of the sheets placed one on top of the other have contacted the stopper, subsequent to the operation of the stopper of the post-processing section in the present embodiment 2.

(2) In FIG. 20, the sensor PS arranged upstream from the inlet roller R11 along the sheet conveyance path detects the passage of the rear ends of the sheets S1 and S2 placed one on top of the other. Then after the lapse of a predetermined time, the drive of the motor M6 is suspended and the rotation of the drive roller R32A, driven roller R32B, conveyance roller R33 and conveyance roller R34 is suspended. Then the conveyance of the sheets S1 and S2 is suspended. In this suspended state, the rear ends of the sheets S1 and S2 in the direction of conveyance stops below and in the vicinity of the stopper 32.

By passing through the conveyance path having a curvature on the upstream side, the sheet S1 reaches the conveyance section 30 earlier than the sheet S2, and hence the rear end of the sheet S1 stops below the regulating position of the stopper 32.

To be more specific, assume the case wherein the sheets S1 and S2 placed one on top of the other are to be fed. As shown in FIG. 2, when the sheets S1 and S2 placed one on top of the other are conveyed along the conveyance path having a curvature from the sheet conveyance path r16 of the conveyance unit B to the sheet conveyance path r31 of the post-processing section C, the front end of the sheet S1 conveyed inside the conveyance path having a curvature passes through the punching section 20 earlier than the front end of the sheet S2 conveyed outside the conveyance path. To be more specific, the length of the conveyance path of the sheet S1 located inside is shorter than that of the conveyance path located outside. Accordingly, the sheets stop, at different positions wherein the end of the sheet S1 is lower than that of the sheet S2, as shown in FIG. 20.

(3) When the sheets S1 and S2 are suspended, the solenoid SD1 as a releasing member operates to move the drive roller R32A away from the driven roller R32B. Simultaneously the solenoid SD2 operates so that the conveyance roller R34 is detached, and sandwiching of the sheets S1 and S2 is released. Two sheets S1 and S2 stored in the conveyance path formed by the curved guide plates 34A and 34B slide along the guide plates 34A and 34B, and are held by frictional force, whereby the sheets S1 and S2 are prevented from falling due to dead weight.

Immediately when sandwiching of the sheets S1 and S2 has been released, the motor M5 of FIG. 11 starts operation so that the alignment section 31 is driven. Then the sheets S1 and S2 are aligned across the width. Upon completion of alignment, the operation of the solenoids SD1 and SD2 is suspended. Pressure contact is applied to the drive roller R32A and driven roller R32B, and to the conveyance roller R34.

(4) Upon completion of alignment, the stopper 32 is swung by the motor M7 and the sheet conveyance path is blocked. In this case, the illustrated upper rear end of the sheet S2 is pressed by the stopper 32 and is positioned at the regulating position L.

(5) Then the drive roller R32A is driven in the reverse direction by the reverse rotation of the motor M6, and the sheet S1 is fed backward to travel upward. The front end of the reverse-fed sheet S1 in the traveling direction hits the stopper 32, and is aligned with the end of the sheet S2, whereby the drive of the motor M6 is suspended. In this case, the driven roller R32B remains stopped without being rotated by the operation of the one-way clutch, despite the reverse rotation of the drive roller R32A, with the result that frictional force is applied to the sheet S2. Thus, the sheet S2 is not conveyed even when the sheet S1 is conveyed.

The conveyance force of the drive roller R32A acts on the sheet S1 through the frictional force with the sheet S1, and move the sheet S1 upward against the frictional force between the sheet S1 and the sheet S2 which is kept stopped by the frictional force between the driven roller R32B and the sheet S2.

Thus, the ends of the sheets S1 and S2 are aligned by hitting the stopper 32.

The motor M6 continues to drive the sheet S1 further upward. However, since the end of the sheet S1 is stopped by the stopper 32, the intermediate section of the sheet S1 forms a loop in the space section formed by the guide plates 34A and 34B and stops. Thus, the ends of the sheets S1 and S2 are correctly aligned, and the motor M6 stops driving.

Figure 22:
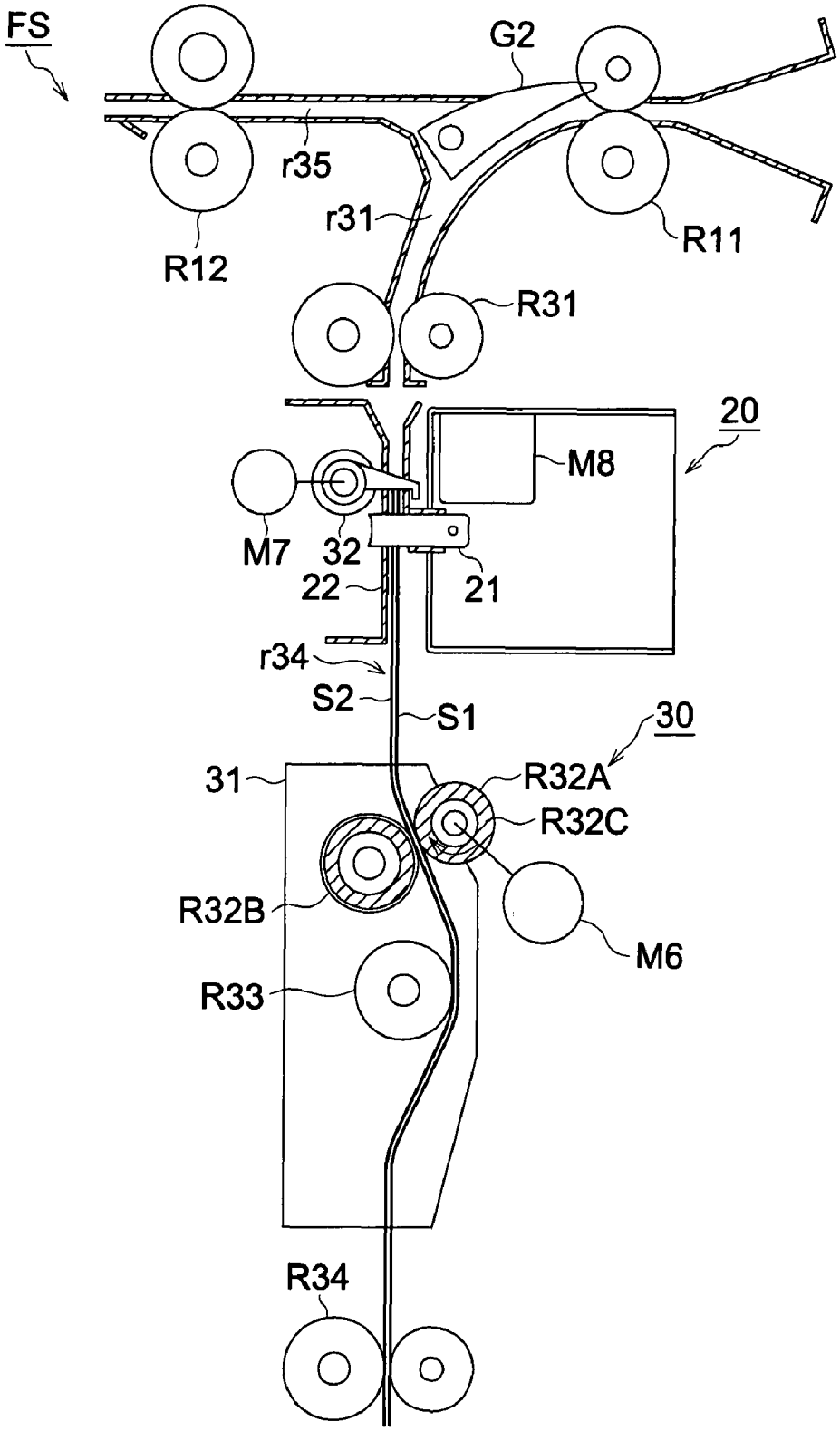
FIG. 22 is a cross sectional view showing that sheets placed one on top of the other are punched in the post-processing section of the present embodiment 2.

(6) In FIG. 22, when the ends of the sheets S1 and S2 have hit the stopper 32 and the sheets have been stopped, the plurality of sheets are punched simultaneously by the punching section 20.

Figure 23:
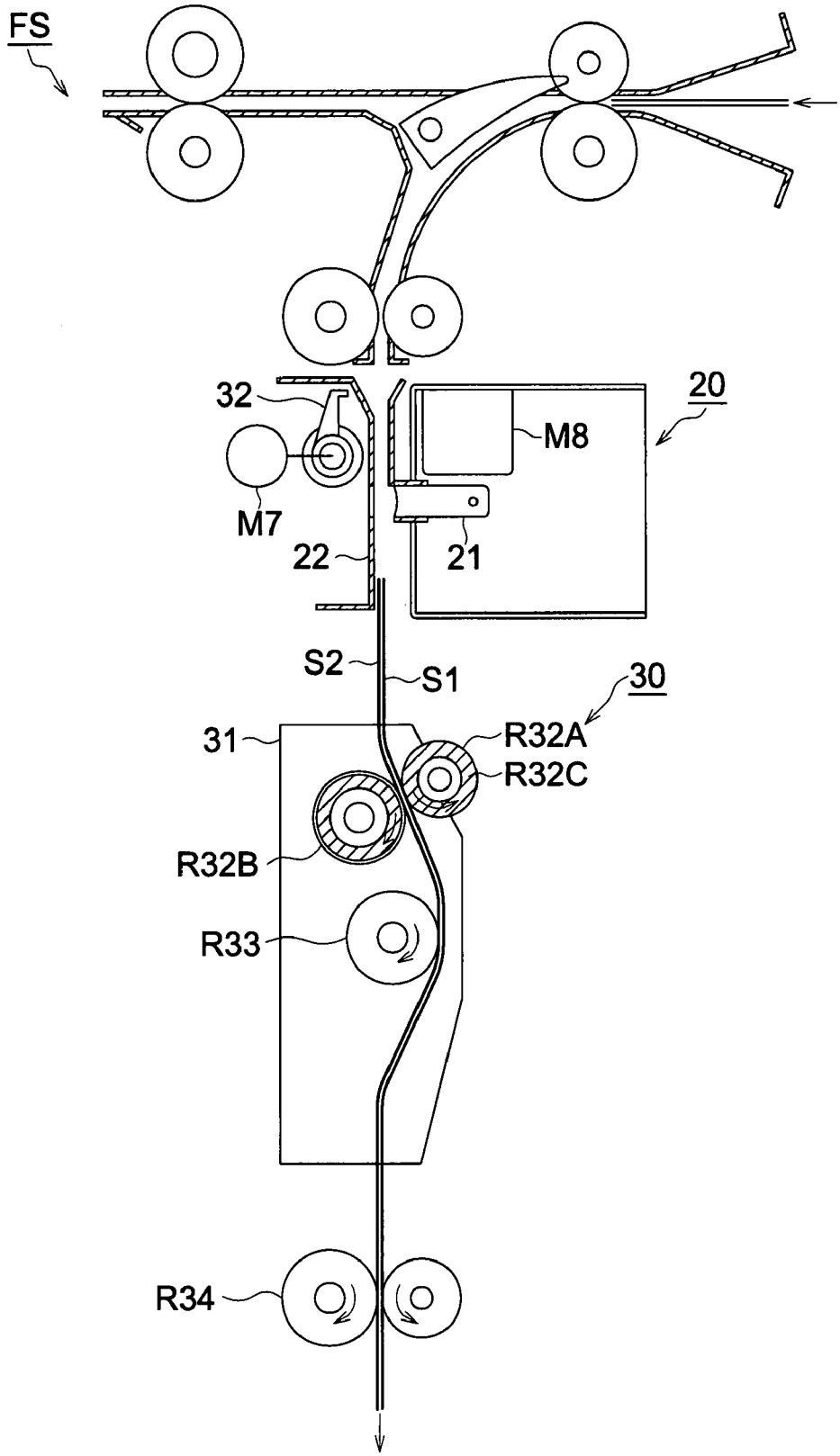
FIG. 23 is a cross sectional view showing how the sheets placed one on top of the other are ejected subsequent to punching in the post-processing section of the present embodiment 2.

(7) In FIG. 23, after punching, pressure contact by the drive roller R32A, driven roller R32B and conveyance roller R34 is released, and hence, sandwiching on the sheets S1 and S2 is released. After the loop formed on the sheets S1 and S2 has been removed, the sheets are again sandwiched. Thus, the front and rear ends of the sheets S1 and S2 are aligned. Then the stopper 32 is swung by the driving device of the solenoid and others so that the sheet conveyance path is kept open. The sheets S1 and S2 sandwiched between the drive roller R32A rotated in the forward direction by the motor M6 and the driven roller R32B are then sandwiched between the conveyance rollers R34 to be conveyed downstream.

In such a post-processing apparatus FS, when the sheets are placed one on top of the other and are conveyed, difference in the lengths of the conveyance path inside and outside results from the curvature of the sheet conveyance path. This causes misalignment of the sheets S1 and S2 placed one on top of the other, and punching misalignment occurs. Accordingly, after the sheet S2 has been positioned with reference to the stopper 32 for aligning the ends of a plurality of sheets, sheets are conveyed in such a way that the only the sheet S1 hits the stopper 32 by the action of the one-way clutch of the driven roller 32B and frictional force. This arrangement allows the ends of the misaligned sheets S1 and S2 to be aligned correctly.

According to the aforementioned method, the two sheets placed one on top of the other can be punched without misalignment using a compact apparatus, independently of the length of the sheet.

As described above, double the processing time can be ensured by punching the two sheets S placed one on top of the other, as compared to the conventional method of punching each sheet. To be more specific, while the two sheets placed one on top of the other are punched, two succeeding sheets S ejected from the image forming apparatus A are fed to the conveyance unit on a continuous basis and are placed one on top of the other to be accommodated. This procedure allows the productivity of the image forming apparatus A to be maintained, despite the presence of the process of punching. This arrangement is effective in an high-speed image forming apparatus connected with a post-processing apparatus.

In the present embodiment, the above description has referred to various forms of post-processing apparatuses combined with the image forming apparatus A. The present embodiment is also applicable to the post-processing apparatus used in combination with the image forming apparatus such as a quick printer, printer and multifunction machine. Further, various forms of processing can be performed as a post-processing device independent of image forming apparatus A.

As described above, the present invention ensures stable and reliable specific post-processing performances. It has been demonstrated to be effective in the image forming apparatus oriented especially in the field of quick printing. Thus, the present invention allows high-speed bookbinding work to be performed based on the print-on-demand method that "provides only a required number of prints at a required time".

The present invention provides the following advantages:

The present invention provides various forms of post-processing work including accurate alignment of the ends of a plurality of sheets placed one on top of the other, and accurate punching of the sheets at a predetermined position.

Further, the present invention allows a plurality of sheets to be placed one on top of the other by a conveyance unit and to be sent to the processing apparatus at the same time. It also ensures high-speed image formation of an image forming apparatus and high-precision post-processing such as punching, without the processing speed of the image forming apparatus being deteriorated, with the result that the productivity of the imaging forming system has been enhanced.

What is claimed is:

1. A post-processing apparatus comprising:

a conveyance unit including (i) a stacker for storing a plurality of sheets placed one on top of another, and (ii) a first conveyance path having a curvature for conveying the plurality of sheets placed one on top of another in the stacker in a sheet conveyance direction while the plurality of sheets are placed one on top of another;

a second conveyance path connected with the first conveyance path and located downstream of the conveyance unit in the sheet conveyance direction;

a stopper which is located downstream of the conveyance unit in the sheet conveyance direction and which is swingable for aligning edges of the plurality of sheets placed one on top of another by making contact with the edges;

a conveyance roller which is rotatable both in a forward and reverse direction and which is provided downstream of the stopper in the sheet conveyance direction;

a punching section for punching the plurality of sheets whose edges are kept in contact with the stopper; and a control section for controlling operation of the stopper, the conveyance roller, and the punching section;

wherein the control section: (i) controls the conveyance roller to convey and stop the plurality of sheets placed one on top of another at a position where a trailing edge of an outside sheet among the plurality of sheets is positioned upstream of a regulating position of the stopper in the sheet conveyance direction and a trailing edge of an inside sheet among the plurality of sheets is positioned downstream of the regulating position of the stopper in the sheet conveyance direction, (ii) then controls the stopper to swing to be moved to a closed position where the stopper closes the second conveyance path and to push the trailing edge of the outside sheet to be moved to the regulating position, (iii) then controls the conveyance roller to rotate reversely to send the inside sheet in an opposite direction to the sheet conveyance direction so as to bring the trailing edge of the inside sheet into contact with the stopper for positioning at the regulating position, and (iv) then controls the punching section to punch a trailing edge side of the plurality of sheets placed one on top of another simultaneously.

2. The post-processing apparatus of claim 1, wherein the conveyance roller comprises:

a drive roller which rotates in a forward direction and in a backward direction; and a driven roller which is driven to rotate while being pressed against the drive roller, wherein the control section controls the drive roller to rotate in the forward direction when introducing the sheets and to rotate in the backward direction when bringing the plurality of sheets into contact with the stopper.

3. The post-processing apparatus of claim 2, further comprising:

an alignment member for aligning the plurality of sheets in the second conveyance path in a sheet width direction perpendicular to the sheet conveyance direction; and a release member for releasing pressure contact between the drive roller and the driven roller, wherein the control section controls driving of the release member to release pressure contact between the drive roller and the driven roller when aligning the sheets in the sheet width direction by the alignment member.

4. The post-processing apparatus of claim 1, wherein the control section controls driving of the stopper such that the stopper opens the second conveyance path when introducing the sheets into the second conveyance path and closes the second conveyance path when bringing the edges of the plurality of sheets in the second conveyance path into contact with the stopper to align the edges.

5. The post-processing apparatus of claim 1, wherein the conveyance roller includes a driven roller having a one way-clutch and a drive roller.

6. The post-processing apparatus of claim 5, wherein the driven roller is driven to rotate by being pressed against the drive roller when introducing the plurality of sheets from the conveyance unit, and is prevented from rotating by the one-way clutch when aligning the edges of the plurality of sheets by reverse rotation of the drive roller.

7. The post-processing apparatus of claim 5, wherein at least one of the drive roller and the driven roller comprises a rubber member.

8. The post-processing apparatus of claim 1, further comprising:

a guide plate having a space section to allow the sheets to form a loop between the stopper and the conveyance roller, wherein the control section performs control such that a loop of the sheets is formed by contact between the edges of the sheets and the stopper, and such that the punching of the sheets is conducted while the loop is kept formed.

9. An image forming system including an image forming apparatus having an image forming section for forming an image on a sheet, and a post-processing apparatus for applying a punching process to the sheet, the post-processing apparatus comprising:

a conveyance unit including (i) a stacker for storing a plurality of sheets placed one on top of another, and (ii) a first conveyance path having a curvature for conveying the plurality of sheets placed one on top of another in the stacker in a sheet conveyance directions while the plurality of sheets are placed one on top of another;

a second conveyance path connected with the first conveyance path and located downstream of the conveyance unit in the sheet conveyance direction;

a stopper which is located downstream of the conveyance unit in the sheet conveyance direction and which is swingable for aligning edges of the plurality of sheets placed one on top of another by making contact with the edges;

a conveyance roller which is rotatable both in a forward and reverse direction and which is provided downstream of the stopper in the sheet conveyance direction;

a punching section for punching the plurality of sheets whose edges are kept in contact with the stopper; and a control section for controlling operation of the stopper, the conveyance roller, and the punching section;

wherein the control section: (i) controls the conveyance roller to convey and stop the plurality of sheets placed one on top of another at a position where a trailing edge of an outside sheet among the plurality of sheets is positioned upstream of a regulating position of the stopper in the sheet conveyance direction and a trailing edge of an inside sheet among the plurality of sheets is positioned downstream of the regulating position of the stopper in the sheet conveyance direction, (ii) then controls the stopper to swing to be moved to a closed position where the stopper closes the second conveyance path and to push the trailing edge of the outside sheet to be moved to the regulating position, (iii) then controls the conveyance roller to rotate reversely to send the inside sheet in an opposite direction to the sheet conveyance direction so as to bring the trailing edge of the inside sheet into contact with the stopper for positioning at the regulating position, and (iv) then controls the punching section to punch a trailing edge side of the plurality of sheets placed one on top of another simultaneously.

10. The image forming system of claim 9, wherein the conveyance roller comprises:

a drive roller which rotates in a forward direction and in a backward direction; and a driven roller which is driven to rotate while being pressed against the drive roller, wherein the control section controls the drive roller to rotate in the forward direction when introducing the sheets and to rotate in the backward direction when bringing the plurality of sheets into contact with the stopper.

11. The image forming system of claim 9, wherein the conveyance roller includes a driven roller having a one way-clutch and a drive roller.

12. The image forming system of claim 11, wherein the driven roller is driven to rotate by being pressed against the drive roller when introducing the plurality of sheets from the conveyance unit, and is prevented from rotating by the one-way clutch when aligning the edges of the plurality of sheets by reverse rotation of the drive roller.

13. The image forming system of claim 9, further comprising:

a guide plate having a space section to allow the sheets to form a loop between the stopper and the conveyance roller, wherein the control section performs control such that a loop of the sheets is formed by contact between the edges of the sheets and the stopper, and such that the punching of the sheets is conducted while the loop is kept formed.

* * * * *